US007457575B2

(12) United States Patent
Tsunoda

(10) Patent No.: US 7,457,575 B2
(45) Date of Patent: Nov. 25, 2008

(54) FUSING DEVICE, IMAGE FORMING APPARATUS, AND BELT

(75) Inventor: Shigeru Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/093,696

(22) Filed: Mar. 30, 2005

(65) Prior Publication Data

US 2005/0220510 A1 Oct. 6, 2005

(30) Foreign Application Priority Data

Apr. 1, 2004 (JP) ..... 2004-108606
Nov. 19, 2004 (JP) ..... 2004-335260

(51) Int. Cl.
*G03G 15/20* (2006.01)

(52) U.S. Cl. ..... 399/329; 399/333

(58) Field of Classification Search ..... 399/329, 399/333

See application file for complete search history.

(56) References Cited

U.S. PATENT DOCUMENTS 5,722,026 A * 2/1998 Goto et al. ..... 399/333
5,860,051 A * 1/1999 Goto et al. ..... 399/329
6,597,888 B1 * 7/2003 Abe et al. ..... 399/329
6,895,208 B2 * 5/2005 Nakatogawa et al. ..... 399/329
7,076,196 B2 * 7/2006 Takahashi et al. ..... 399/328
2003/0035661 A1 * 2/2003 Kabata et al. ..... 399/162
2004/0057758 A1 * 3/2004 Takahashi et al. ..... 399/328
2004/0179876 A1 * 9/2004 Fuma et al. ..... 399/329

FOREIGN PATENT DOCUMENTS

JP 6-348156 A 12/1994

* cited by examiner

*Primary Examiner*—David M Gray
*Assistant Examiner*—Bryan Ready
(74) *Attorney, Agent, or Firm*—Panitch Schwarze Belisario & Nadel LLP

(57) ABSTRACT

To move a fusing belt smoothly, and to convey a recording medium smoothly, a fusing device according to this invention has a belt, a pressure member disposed in contact with the belt, and a pushing member disposed inside the belt, pushing the belt. Where a friction coefficient of an inner circumferential surface of the belt is set to $\mu_i$, a friction coefficient of a transit area for a recording medium on an outer circumferential surface of the belt is set to $\mu_{01}$, and where a friction coefficient of a non-transit area for the recording medium on the outer circumferential surface of the belt, having a friction coefficient rendered larger than the friction coefficient $\mu_{0i}$, is set to $\mu_{02}$, a relation of $\mu_{01}<\mu_i<\mu_{02}$ is satisfied. Therefore, even where the recording medium having a small friction coefficient is used, or where the pressure member having mold releasing property is used, moving force for moving the belt and conveyance for conveying the recording medium can be increased.

6 Claims, 12 Drawing Sheets

FUSING DEVICE, IMAGE FORMING APPARATUS, AND BELT

BACKGROUND OF THE INVENTION

1. Field of the Invention

This invention relates to a fusing device, an image forming apparatus, and a belt.

2. Description of Related Art

With an image forming apparatus such as, e.g., a printer, a photocopier, a facsimile machine, or the like, for example, with an electrophotographic printer, a fusing device of a heating roller type has been conventionally disposed to fuse an toner image transferred onto a paper serving as a recording medium, and the fusing device has a fusing roller and a pressure roller, in which the toner image is fused onto the paper while the paper transits through a nipping portion formed between the fusing roller and the pressure roller.

On the other hand, with a fusing device of a belt type capable of fusing with use of an endless belt (hereinafter referred to as a "fusing belt"), electric power can be saved compared with the fusing device of the heating roller type, and necessary duration for changing a status of the fusing device from suspended into ready for fusing, i.e., duration of increasing temperature can be shortened (see, e.g., Japanese Patent Application Publication No. H6-348,156).

FIG. 2 is a cross-sectional view showing an essential part of the conventional fusing device of the belt type.

In FIG. 2, numeral 11 is a fusing belt disposed with a halogen lamp 21, rotated in a direction of arrow a, numeral 12 is a pressure roller disposed as in contact with the fusing belt 11, and numeral 13 is a pushing member disposed inside the fusing belt 11, pushing the fusing belt 11 onto the pressure roller 12, forming a nipping portion N between the fusing belt 11 and the pressure roller 12.

When the pressure roller 12 is rotated in a direction of arrow R upon driving motor M, the fusing belt 11 is driven to move with frictional force exerting between the pressure roller 12 and the fusing roller 11, in a direction of the arrow a while sliding on the pushing member 13. When the halogen lamp 21 renders the nipping portion N have a prescribed temperature and paper P is conveyed in a direction of arrow b at the nipping portion N, toner image T is fused onto the paper P.

In that case, since the fusing belt 11 does not need to be formed as stretched among a plurality of members such as, e.g., a tension roller or the like, thermal radiation of portions other than the nipping portion N can be reduced upon enhancing thermal insulation property and reducing thermal capacity of the pushing member 13. Therefore, the duration of increasing temperature can be shortened to improve the fusing device so as to start quickly.

It is to be noted that when conveyance speed of the paper P is accelerated to accelerate speed of the fusing device, the paper P needs to be supplied with sufficient heat. Thus, a width of the nipping portion N (hereinafter referred to as a "nipping width") is widened to increase a pressure of the nipping portion N.

In the meantime, on each of outer circumferential surfaces of the fusing belt 11 and the pressure roller 12, a surface layer made of material having high mold releasing property such as, e.g., a fluoric resin such as, e.g., a perfluoroalkylvinylether copolymer resin (hereinafter referred to as a "PFA"), a polytetrafluoroethylene (hereinafter referred to as a "PTFE"), or the like is to be formed to prevent toners composing the toner image T, paper dusts, etc. from attaching in accordance with the conveyance of the paper P.

Although the conveyance speed of the paper P and the moving speed of the fusing belt 11 depend on rotating speed of the pressure roller 12, the rotating speed easily changes when the pressure roller 12 has large thermal expansion amount, so that the paper P is occasionally pulled by the fusing device when striding across a transfer unit and the nipping portion N in an image forming unit, and in this case, the toner image undesirably lengthens or shifts to deteriorate image quality.

In that case, where a thickness of an elastic layer composing the pressure roller 12 is reduced to reduce the thermal expansion amount, it becomes hard to obtain the sufficient nipping width, so that the fusing device can not be accelerated. Thus, the outer circumferential surface of the pressure roller 12 is covered with a tube made of the fluoric such as, e.g., the PFA or the like, and a stress is applied on the pressure roller 12 from the outside to reduce the thermal expansion amount of the pressure roller 12 so that the rotating speed is suppressed from changing.

However, with the above described conventional fusing device, when the outer circumferential surface of the pressure roller 12 is covered with the tube made of the fluoric resin such as, e.g., the PFA or the like, the frictional force between the pressure roller 12 and the fusing belt 11 as well as the frictional force between the pressure roller 12 and the paper P are reduced, so that depending on a paper type, change of circumstances, or the like, a case may occur where neither the fusing belt 11 can be smoothly moved, nor can the paper P be smoothly conveyed.

It is an object of this invention to solve the above problems and further to provide a fusing device, an image forming device, a belt capable of moving the belt to smoothly convey the recording medium.

SUMMARY OF THE INVENTION

To solve the above problems, a fusing device according to this invention has a belt, a pressure member disposed as in contact with the belt, and a pushing member disposed inside the belt, pushing the belt.

Where a friction coefficient of an inner circumferential surface of the belt is set to $\mu_i$, a friction coefficient of a transit area for a recording medium on an outer circumferential surface of the belt is set to $\mu_{01}$, and where a friction coefficient of a non-transit area for the recording medium on the outer circumferential surface of the belt, having a friction coefficient rendered larger than the friction coefficient $\mu_{01}$, is set to $\mu_{02}$, a relation of $\mu_{01}<\mu_i<\mu_{02}$ is satisfied.

The fusing device according to this invention has a belt, the pressure member disposed in contact with the belt, and the pushing member disposed inside the belt, pushing the belt.

Where the friction coefficient of the inner circumferential surface of the belt is set to $\mu_i$, the friction coefficient of the transit area for the recording medium on the outer circumferential surface of the belt is set to $\mu_{01}$, and where the friction coefficient of the non-transit area for the recording medium on the outer circumferential surface of the belt, having the friction coefficient rendered larger than the friction coefficient $\mu_{01}$, is set to $\mu_{02}$, the relation of $\mu_{01}<\mu_i<\mu_{02}$ is satisfied.

In that case, even where the recording medium having a small friction coefficient is used, or even where the pressure member having mold releasing property is used, moving force for moving the belt and conveyance force for conveying the recording medium can be greatened. Thus, the belt can be smoothly moved and the recording medium can be smoothly conveyed.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF PREFERRED EMBODIMENTS OF THE INVENTION

Hereinafter, embodiments according to this invention will be described in detail in reference to drawings. In this case, an electrophotographic printer defined as an image forming apparatus will be described.

Figure 6:
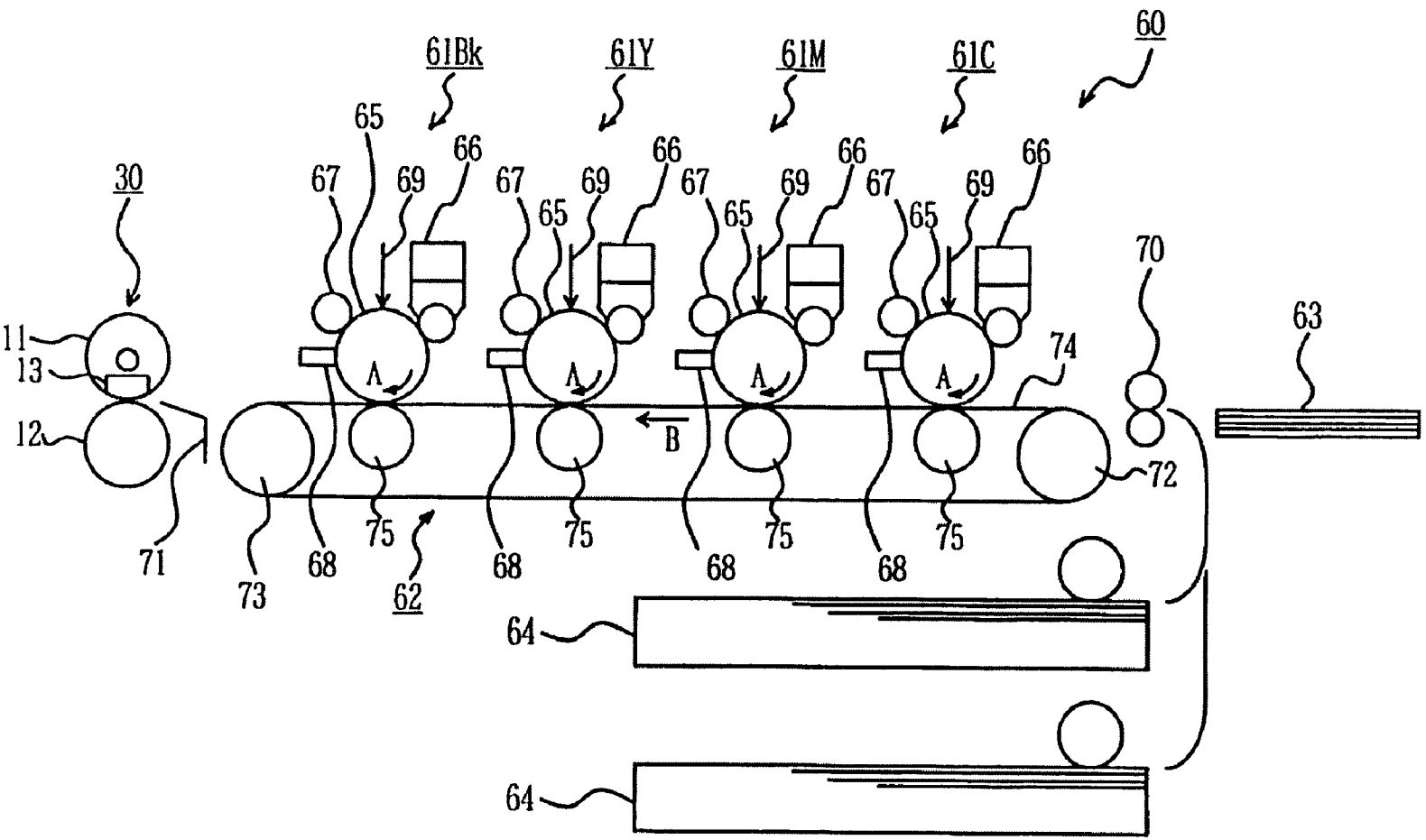
FIG. 6 is a schematic view of a printer according to the first embodiment of this invention.

FIG. 6 is a schematic view of a printer according to the first embodiment of this invention.

As shown in FIG. 6, a printer 60 is composed of image generating devices 61C, 61M, 61Y, 61Bk for generating toner images defined as a developer image in each color, i.e., cyan, magenta, yellow, and black, a transfer device 62 of a belt type disposed as facing the image generating devices 61C, 61M, 61Y, 61Bk, forming transfer areas respectively in each color between the transfer device 62 and the image generating devices 61C, 61M, 61Y, 61Bk, transferring the toner images respectively in each color onto a paper serving as recording medium, a manual feed tray 63 serving as a first medium supplier for feeding the paper serving as the recording medium to the transfer areas, a feeding cassette 64 serving as a second medium supplier for feeding the paper to the transfer areas, disposed corresponding to each paper types, a regist roller 70 for supplying the paper fed with the manual feed tray 63 or the feeding cassette 64 to each of the transfer areas in accordance with timing for image generation with the image generating devices 61C, 61M, 61Y, 61Bk, and a fusing device 30 for fusing the toner image after transferred in the transfer areas. The fusing device 30 has a fusing belt 11 serving as a belt, a pressure roller 12 serving as a pressure member, disposed as in contact with the fusing belt 11, a pushing member 13 disposed inside the fusing belt 11, pushing the fusing belt 11, a guide 71, etc.

It is to be noted that as the paper, not only an OHP paper, a card, a postcard, a thick paper with a basis weight of approximate 100 [g/m$^2$] or higher, an envelope, etc. but also a paper having high thermal capacity, i.e., a special paper can bee used other than a plain paper commonly used in, e.g., copying or the like.

Each of the image generating devices 61C, 61M, 61Y, 61Bk has the same structure, and composes of a photosensitive drum 65 serving as an image carrier, disposed rotatably in a direction of arrow A, a charging roller 67 serving as a charging device, disposed in sequence, in a rotation direction of the photosensitive drum 65, a developing device 66, a cleaning device 68, etc, in which each of the image generating devices 61C, 61M, 61Y, 61Bk is subjected to exposure light 69 from an exposure device, not shown, between the charging device 67 and the developing device 66.

It is to be noted that the transfer device 62 has a first roller 72, a second roller 73, an transfer belt 74 serving as an endless transfer medium, disposed as stretched between the first roller 72 and the second roller 73, moved in a direction of arrow B, transfer rollers 75 disposed rotatably inside the transfer belt 74, as facing each of the image generating devices 61C, 61M, 61Y, 61Bk.

Operation of the printer 60 thus structured is described next.

First, when an operator turns on a power supply, not shown, of the printer 60 and implements an operation for starting the image generation, each of the photosensitive drums 65 is rotated in the direction of the arrow A, thereby charged by the charging roller 67 in accordance with rotation. Subsequently, each of the photosensitive drums 65 is subjected to the exposure light 69, and an electrostatic latent image corresponding to image information is formed on a surface of each photosensitive drum 65. The developing device 66 then attaches the toner serving as a developer onto the photosensitive drum 65 to develop the electrostatic latent image, thereby forming the toner image.

The toner images respectively in each color of cyan, magenta, yellow, and black are transferred in sequence onto the paper in accordance with the moving of the transfer belt 74 in the direction of the arrow B, so that a multicolored toner image is formed. Subsequently, the paper is delivered to the guide 71, thereby supplied through the guide 71 to a nipping portion in the fusing device, and the multicolored toner image on the paper is heated, pressured, and fused onto the paper.

Furthermore, the toners remaining on the photosensitive drum 65 are scratched off and removed by the cleaning device 68.

It is to be noted that in this embodiment, the toner image on the photosensitive drum 65 is to be directly transferred onto the paper, but can be transferred onto the paper after transferred once onto the transfer medium.

Herein, frictional force occurring during paper transit in a standard fusing device is first described.

Figure 3:
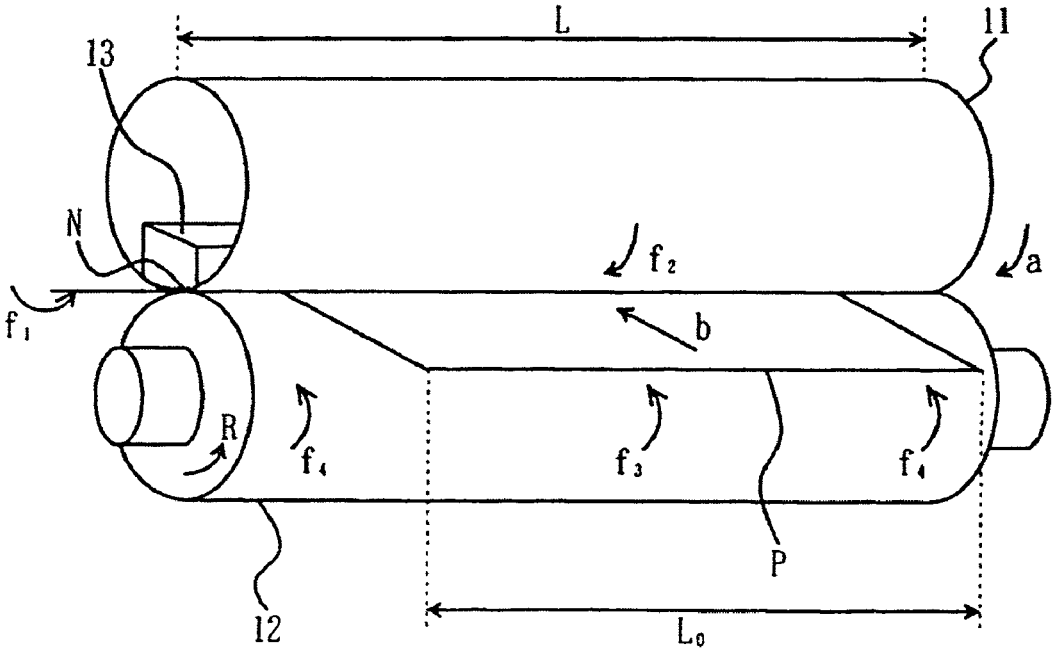
FIG. 3 PRIOR ART
FIG. 3 is a view showing frictional force occurring during paper transit in a standard fusing device of the belt type.

FIG. 3 is a view showing the frictional force occurring during the paper transit in a standard fusing device of the belt type.

In FIG. 3, numeral 11 is a fusing belt rotated in a direction of arrow a: numeral 12 is a pressure roller disposed as in contact with the fusing belt 11, numeral 13 is a pushing member disposed inside the fusing belt 11, pushing the fusing belt onto the pressure roller 12, forming the nipping portion N between the fusing belt 11 and the pressure roller 12, numeral $L_0$ is a maximum paper transit width of the paper P capable of transiting through the fusing device, and mark L is a total length of the fusing belt 11, in which the L is rendered longer than the maximum paper transit width $L_0$ in this embodiment, but can be rendered equal to the maximum paper transit width $L_0$.

Where the fusing belt 11 is rotated in the direction of the arrow a, the pressure roller 12 is rotated in direction of arrow R, and the paper P transits through the nipping portion in a direction of arrow b, the frictional force $f_1$ exerts between an inner circumferential surface of the fusing belt 11 and a contact surface of the pushing member 13, in a direction of preventing the fusing belt 11 from moving, frictional force $f_2$ exerts in a direction of moving through the paper P the fusing belt 11, between an outer circumferential surface of the fusing belt 11 and a surface of the paper P inside an area in the nipping portion N, where the paper P transits, i.e., inside a transit area, frictional force $f_3$ exerts between an outer circumferential surface of the pressure roller 12 and a back-side of the paper P, in a direction of conveying the paper P, and frictional force $f_4$ exerts in a direction of moving directly the fusing belt 11, between the outer circumferential surface of the fusing belt 11 and the outer circumferential surface of the pressure roller 12 inside both left and right areas of the transmission area for the paper P, i.e., a non-transit area.

In that case, to move the fusing belt 11 smoothly and to convey the paper P smoothly, an expression of $f_1<f_2+f_4=f_3$ needs to be satisfied with respect to each of the frictional force $f_1$, $f_2$, $f_3$, $f_4$.

However, where surface layers made of a fluoric resin are respectively formed the outer circumferential surfaces of the fusing belt 11 and the pressure roller 12 as described above, resultant force of the frictional force $f_2$, $f_4$, i.e., $f_2+f_4$, can not be sufficiently increased.

Thus, the contact surface of the pushing member 13 is coated with a low frictional force layer or coated with grease for sliding to reduce the frictional force $f_1$, however, since the coating with the low frictional force layer, the grease for sliding, or the like has a low durability, the frictional force $f_1$ is increased when a deterioration progresses, thereby satisfying an expression of $f_1>f_2+f_4$, so that the fusing belt 11 can not be moved smoothly to cause slip between the fusing belt 11 and the paper P, thereby causing large disorder in the image or crimples on the paper P.

Furthermore, when the paper P having a small friction coefficient is used in environment such as high temperature and humidity, and rendered to transit through the nipping portion N, the fiction $f_2$ is extremely reduced to satisfy the expression of $f_1>f_2+f_4$, so that likewise the above, the fusing belt 11 can not be moved smoothly to cause the slip between the fusing belt 11 and the paper P, thereby causing the large disorder in the image or the crimples on the paper P.

Furthermore, since the surface layer made of the fluoric resin is formed on the outer circumferential surface of the pressure roller 12, the frictional force $f_3$ is reduced to satisfy an expression of $f_2>f_3$, thereby causing the slip between the pressure roller 12 and the paper P, so that the paper P can not be smoothly conveyed. This phenomenon tends to occur more easily when image forming speed (approximately equal to rotating speed of the pressure roller 12) is higher.

In the meantime, the relation between the friction coefficient $\mu_1$ of the outer circumferential surface of the fusing belt 11 and the friction coefficient $\mu_2$ of the outer circumferential surface of the pressure roller 12 is desirably set to $\mu_1<\mu_2$. This is because that on a side of the paper P, where the image is formed, mold releasing property between the fusing belt 11 and the toner image needs to be heightened upon reducing the friction coefficient $\mu_1$ of the fusing belt 11 while on a side of paper P, where the image on the paper P is not formed, conveyance force for the paper P with rotation of the pressure roller 12 needs to be greatened upon increasing the friction coefficient $\mu_2$ in a range where the mold releasing property between the pressure roller 12 and the toner image at a time of printing is satisfied.

Therefore, the pressure roller 12 can be formed upon forming silicone rubber made layer on a core metal or upon covering fluoric rubber latex mixed with the fluoric resin on the silicone rubber, without forming the surface layer made of the fluoric resin on the outer circumferential surface of the pressure roller 12. However, in this case, the durability of the pressure roller 12 is undesirably reduced.

Furthermore, the friction coefficient of the outer circumferential surface of the pressure roller 12 is intended to increase upon covering the fluoric resin added with a resin having a high friction coefficient thereon, however, even where the friction coefficient can be increased, the mold releasing property, the durability, or the like is undesirably reduced by that much.

Based on the above premise, the fusing device 30 according to this invention is next described, in which the paper P can be smoothly conveyed.

Figure 1:
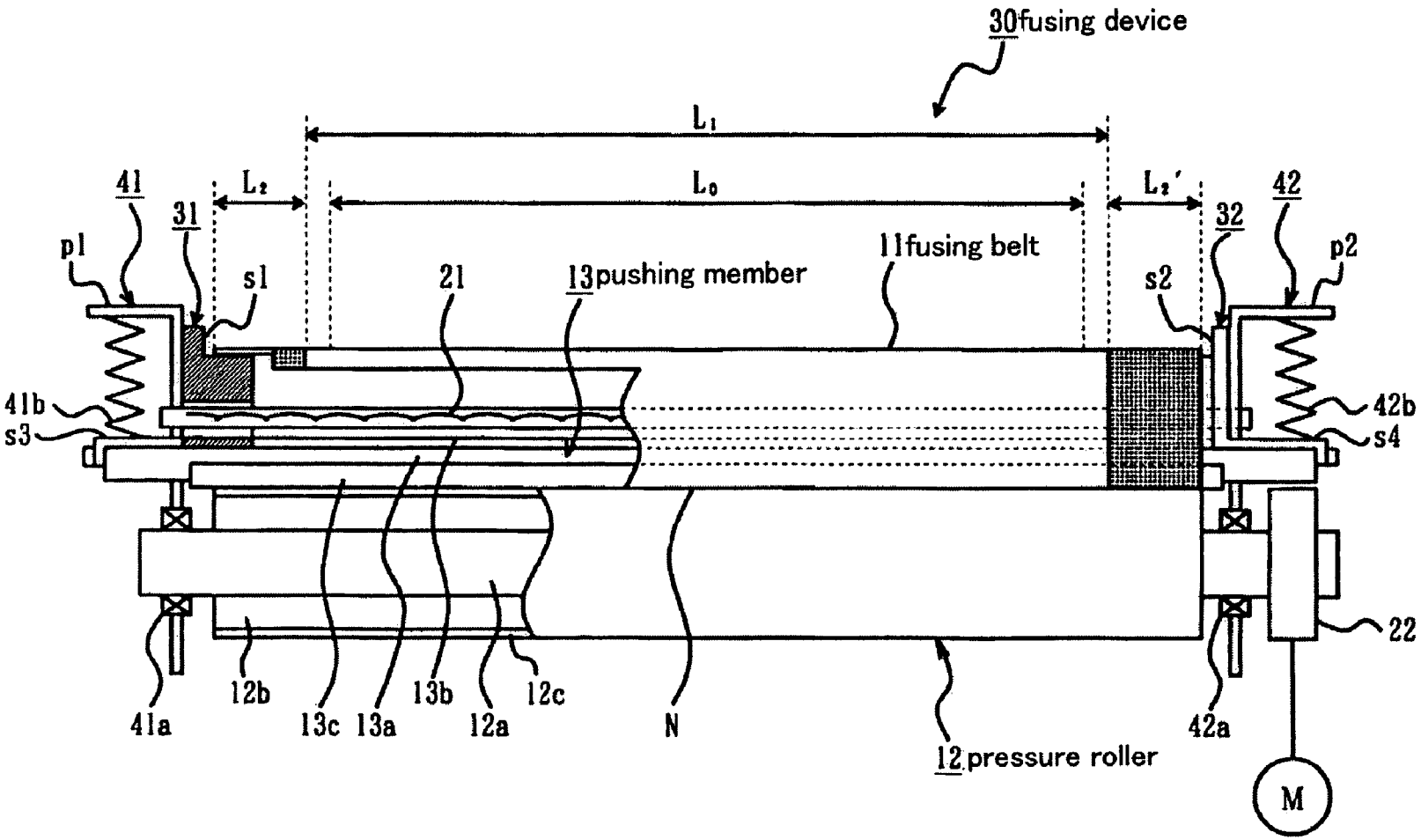
FIG. 1 is a partial cross-sectional view showing an essential part of a fusing device according to the first embodiment of this invention.
Figure 2:
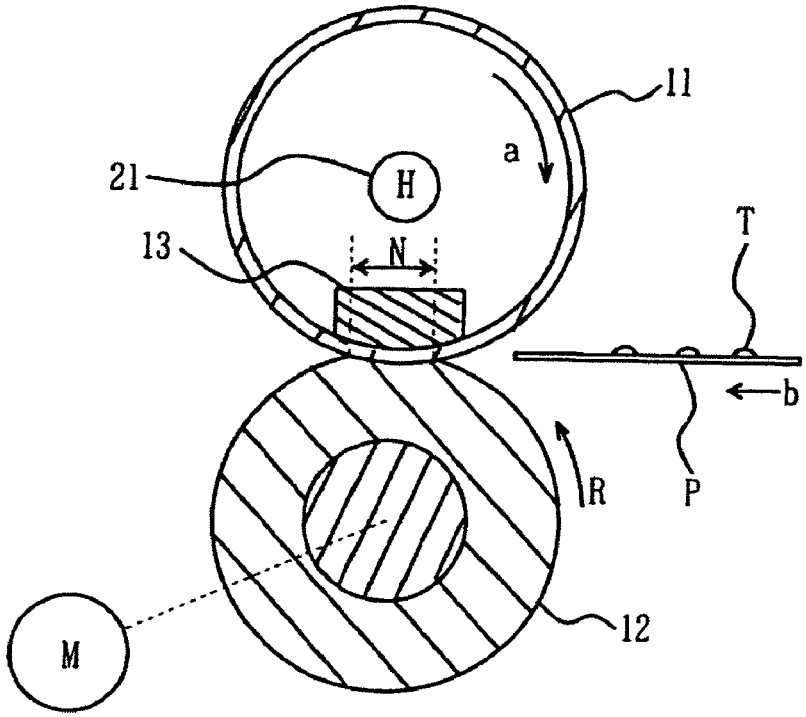
FIG. 2 PRIOR ART
FIG. 2 is a cross-sectional view showing an essential part of a conventional fusing device of a belt type.
Figure 4:
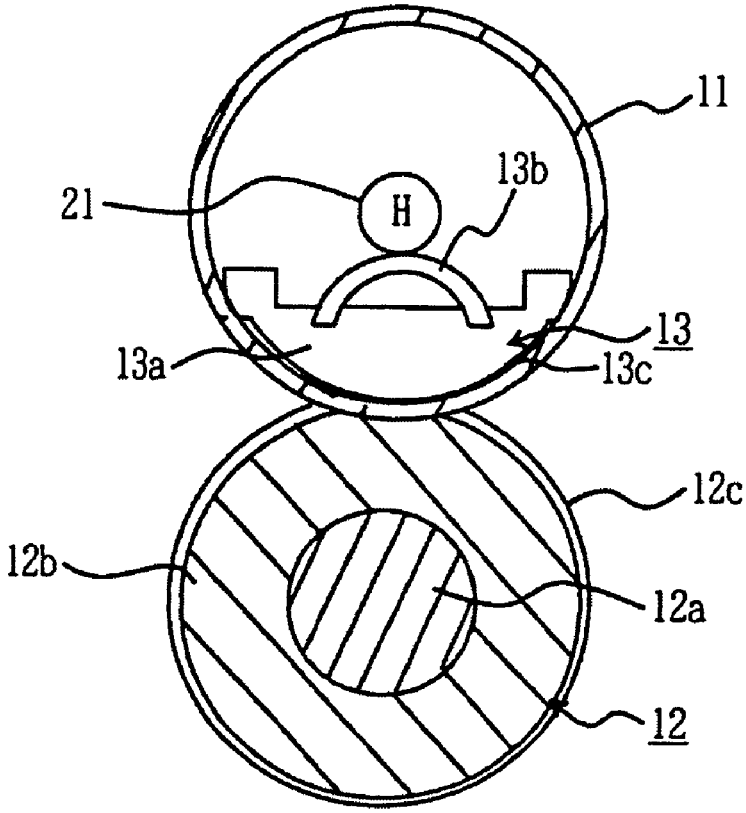
FIG. 4 is a cross-sectional view showing an essential part of the fusing device according to the first embodiment of this invention.
Figure 5:
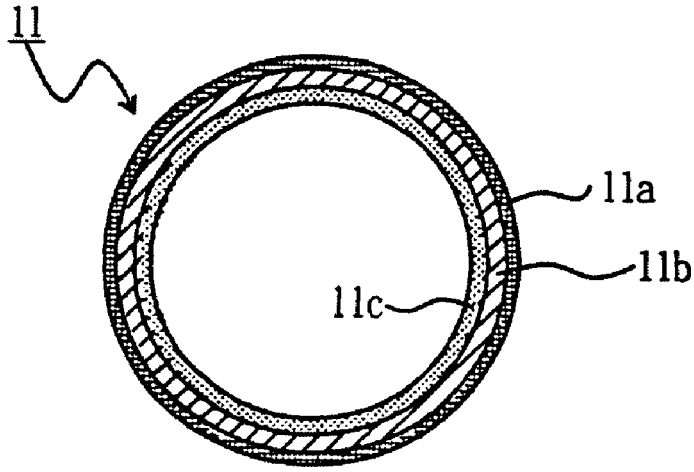
FIG. 5 is a cross-sectional view of the fusing belt according to the first embodiment of this invention.

FIG. 1 is a partial cross-sectional view showing an essential part of the fusing device according to the first embodiment of this invention, FIG. 4 is a cross-sectional view showing an essential part of the fusing device according to the first embodiment of this invention, and FIG. 5 is a cross-sectional view of the fusing belt according to the first embodiment of this invention.

In the drawings, numerals 41, 42 are respectively left and right side plates of the fusing device body, in which the pressure roller 12 is rotatably supported with the side plates 41, 42 through bearings 41*a*, 42*a*, at each end of a core metal shaft 12*a*. One end of the core metal shaft 12*a* is equipped with a gear 22, in which rotation is transmitted from a motor M serving as a driving portion to the gear 22, thereby rotating the pressure roller 12.

According to this embodiment, a halogen lamp 21 with an output of 800 [W] is disposed as a heating source inside the fusing belt 11 to heat up the fusing belt 11. A controller, not shown, sends electric current to the halogen lamp 21 to heat up the fusing belt 11 from the inside, thereby maintaining a surface temperature of the fusing belt 11 at a predetermined temperature suitable for fusing (e.g., 150 to 200 degrees). It is to be noted that a plurality of the halogen lamps may be disposed according to a paper width, and the electric current may be selectively sent to a predetermined halogen lamp according to the transiting paper.

The pushing member 13 is extended inside the fusing belt 11, in an axial direction of the fusing belt 11, and composed of material having rigidity as well as thermal resistance, i.e., in this embodiment, the pushing member 13 has a heat-resisting resin made member 13*a* disposed as in contact with the inner circumferential surface of the fusing belt 11 and a metal rigid member 13*b* made in letter U shape disposed above the heat-resisting resin made member 13*a* as hemming in the heat-resisting resin made member 13*a* in a supporting manner, in which the heat-resisting resin made member 13*a* also functions as a guiding member for guiding the fusing belt 11 to the nipping portion N.

In this embodiment, a surface layer 13*c* made of the PFT is formed as a sliding member on the contact surface of the heat-resisting resin made member 13*a*, in contact with the fusing belt 11 upon covering a tube made of the fluoric resin with thickness of 50 [μm] having the high mold releasing property, such as, e.g., PFA on a circumference of the heat-resisting resin made member 13*a*, so that the frictional force between the pushing member 13 and the inner circumferential surface of the fusing belt 11 is reduced to move the fusing belt smoothly.

As the sliding member, a surface layer made of the PTFE instead of PFT may be formed or the heat-resisting resin made member 13*a* may be covered with, e.g., a glass cloth coated with a fluoride, or the like. Furthermore, as the sliding member, an elastic layer made of the silicone rubber having high thermal resistance may be formed on the heat-resisting resin made member 13*a*. In this case, it is desirable that the elastic layer is further covered with, e.g., the glass cloth coated with the fluoride or the like while impregnated with, e.g., fluoric oil or the like.

Numerals 31, 32 are flange members functioning as a guide for stabilizing a conveyance of the fusing belt 11, respectively disposed both ends of the fusing belt 11, and the flange members 31, 32 respectively have restriction surfaces s1, s2 facing the fusing belt 11, disposed with a prescribed distance, e.g., in this embodiment, a distance of 1 to 2 [mm], between the restriction surfaces s1, s2 and an end surface of the fusing belt 11, in which the restriction surfaces s1, s2 restrict a position in a longitudinal direction of the fusing belt 11. The restriction surfaces s1, s2 do not contact with the fusing belt 11 when the fusing belt 11 is positioned in a regular position while coming in contact with the end surface of the fusing belt 11 to position the fusing belt 11 in a prescribed range when the fusing belt 11 sidles up to one side or the other side in the longitudinal direction during rotating.

On the pressure roller 12, an elastic layer 12*b* in a roller shape, made of sponge material having high thermal resistance and thermal insulation property is formed on an outer circumferential surface of the core metal shaft 12*a*, and a mold-releasing layer 12*c* having high mold releasing property and durability is formed on an outer surface of the elastic layer 12*b*. In this embodiment, the mold-releasing layer 12*c* is formed upon covered with the tube made of the PFA having a thickness of 30 [mm]. The pressure roller 12 is rendered to have an outer diameter of 35 [mm] and a length of 450 [mm].

A fusing belt assembly composed of, e.g., the halogen lamp 21, the pushing member 13, the flange members 31, 32, the fusing belt 11, etc. is disposed above the pressure roller 12, in a state of projecting respectively both ends to outsides of the left and right side plates 41, 42. Furthermore, pressure springs 41*b*, 42*b* serving as a energizing member are disposed between outwardly bent portions p1, p2 of the left and right side plates 41, 42, and spring propping surfaces s3, s4 of the flange members 31, 32.

Energizing force with the pressure springs 41*b*, 42*b* energizes the fusing belt assembly downward and renders the flange members 31, 32 and the pushing member 13 come in a pressurized contact with an upper surface of the pushing roller 12 through the fusing belt 11 with an total pressure of approximate 10 to 30 [kgf], thereby forming the nipping portion N.

On the fusing belt 11, an outer circumferential surface of an endless base material 11*c* made of an electrically conductive metal having strong magnetism, such as, e.g., nickel, iron, stainless steel, nickel-cobalt alloy, or the like is coated with a primer layer for strengthening attachment, and thereafter covered thinly with, e.g., silicone rubber, fluoric rubber, fluorosilicone rubber or the like, thereby forming an elastic layer 11*b*.

Furthermore, the primer layer is coated on the outer circumferential surface of the elastic layer 11*b*, and the mold-releasing layer 11*a* having high mold releasing property and thermal resistance, such as, e.g., the PFA, the PTFE, a FEP, or the like is formed in the transit area to prevent the toner from attaching to the primer layer. Other than the fluoric resin, the material such as, e.g., the silicone rubber, the fluorosilicone rubber, a fluoric rubber, or the like can be used.

Transmission efficiency of heat generating energy from the halogen lamp 21 to the toner image is higher when the base material 11*c* is thinner while moving stability of the fusing belt 11 is higher when the base material 11*c* is thicker. Thus, a thickness of the base material 11*c* is rendered of 10 [μm] or more and less than 100 [μm]. Furthermore, the transmission efficiency of the heat generating energy from the halogen lamp 21 to the toner image is higher when the elastic layer 11*b* is thinner while moving stability of the fusing belt 11 and property for following a change in a thickness of the toner image are higher to improve the image quality when the elastic layer 11*b* is thicker. Thus, a thickness of the elastic layer 11*b* is rendered of 100 [μm] or more and less than 1000 [μm]. Furthermore, the transmission efficiency of the heat generating energy from the halogen lamp 21 to the toner image, separating property of the toner, and the property for following the change in the thickness of the toner image are higher when the mold-releasing layer 11*a* is thinner while anti-abrasion property and the durability are higher when the mold-releasing layer 11*a* is thicker. Thus, a thickness of the mold-releasing layer 11*a* is rendered of 1 [μm] or more and less than 100 [μm].

In this embodiment, the stainless steel having an inner diameter of 35 [mm] and a thickness of 40 [μm] is used as the base material 11*c*, the elastic layer 11*b* is formed upon rendering the silicone rubber in a liquid form having a rubber strength of 5 degrees (JIS-A) have a thickness of 200 [μm], and the mold-releasing layer 11*a* is formed upon covered the tube made of PFA having a thickness of 30 [μm] so that the fusing belt 11 is formed, in which an outside dimension is such that a total thickness including the primer layer is of approximate 270 [μm] and as a total length is of 450 [μm].

On the fusing belt 11, the mold-releasing layer 11*a* is formed on the paper transit area, not on the non-paper transit area, so the elastic layer 11*b* is exposed in the non-paper transit area. It is to be noted that a mold-releasing layer width $L_1$ of the mold-releasing layer 11*a* is rendered slightly larger than the maximum paper transit width $L_0$ of the paper P.

In this embodiment, with respect to the maximum paper transit width $L_0$ of 330 [μm], the mold-releasing layer width $L_1$ of 336 [mm] is formed, in which a margin composed of a distance of 3 [mm] is placed on each of the left and right sides, while elastic layer exposed widths $L_2$, $L_2'$ of 57 [mm] are respectively formed next to the left and right sides. Therefore, the total length L of the fusing belt 11 is determined by expression, $L=L_1+L_2+L_2'=336+57\times2=450$ [mm].

Operation of the fusing device 30 thus structured is described next.

The rotation is transmitted from the motor M to the pressure roller 12, thereby rotating the pressure roller 12 at a prescribed rotating speed. Accordingly, the frictional force exerting between the outer circumferential surface of the pressure roller 12 and the outer circumferential surface of the fusing belt 11 at the nipping portion N renders the fusing belt 11 move at a speed approximately equal to the rotating speed of the pressure roller 12 with the inner circumferential surface of the fusing belt 11 sliding as in a closely contact with to the contact surface of the pushing member 13.

In this bout, the fusing belt 11 is rendered in a state where portions other than the nipping portion N and other than portions near the nipping portion N are not added with tensions, and when the fusing belt 11 is to shift in a longitudinal direction of the pushing member 13 in accordance with moving, the end surface of the fusing belt 11 comes in contact with the restriction surfaces s1, s2. Therefore, the fusing belt 11 is restricted from shifting in a width direction.

Furthermore, when the electric current is sent to the halogen lamp 21, and the outer circumferential surface (nipping portion N) of the fusing belt 11 is heated up with the heat generated with the halogen lamp 21 to have a prescribed temperature, the paper P is supplied to the nipping portion N and the toner image comes in closely contact with the outer circumferential surface of the fusing belt 11 to shift together with the fusing belt 11. During that operation, the heat from the halogen lamp 21 is conducted through the fusing belt 11 to the toner image, so that the toner image is heated, pressured, and fused onto the paper. After transiting through the nipping portion N, the paper is separated because of a curvature, from the outer circumferential surface of the fusing belt 11, thereby delivered.

Frictional force occurring during the paper transit in the fusing device 30 is described next.

Figure 7:
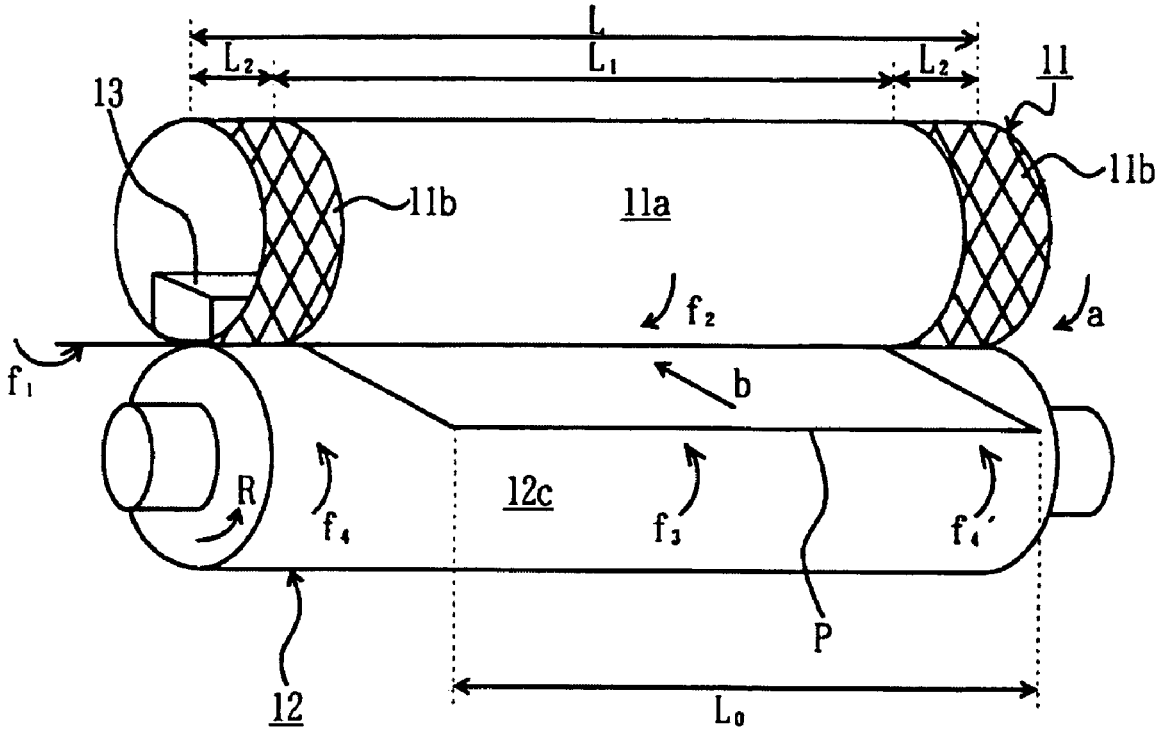
FIG. 7 is a view showing frictional force occurring during paper transit according to the first embodiment of this invention.
Figure 8:
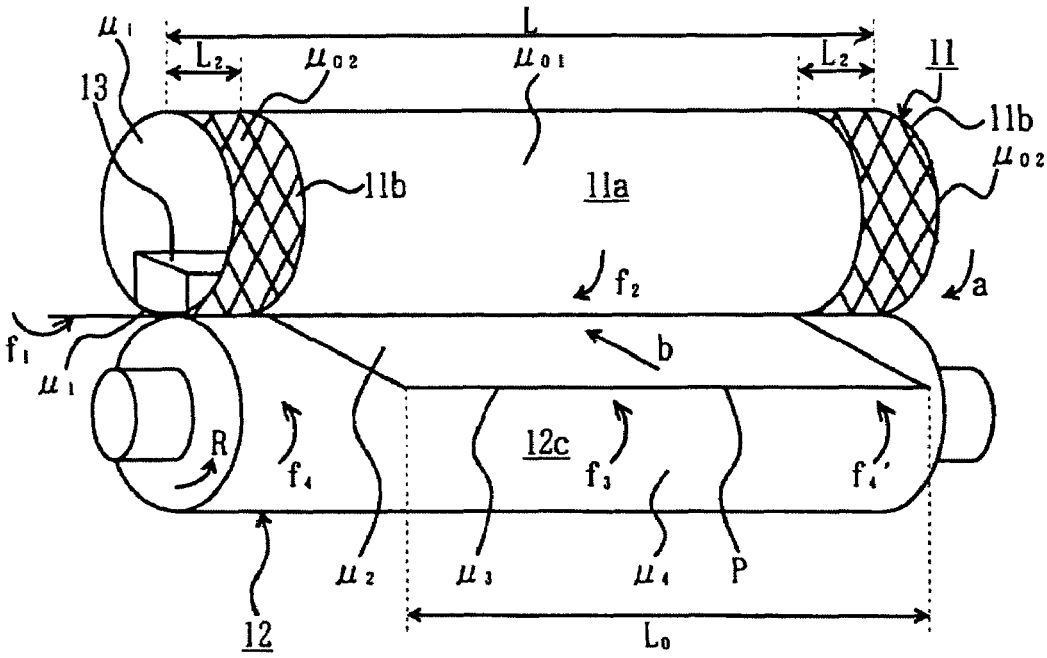
FIG. 8 is a view showing a friction coefficient of each member of the fusing device according to the first embodiment of this invention.

FIG. 7 is a view showing the frictional force occurring during the paper transit according to the first embodiment of this invention, and FIG. 8 is a view showing the friction coefficient of each member of the fusing device according to the first embodiment of this invention.

When the paper P is conveyed in a direction of the arrow b through the nipping portion N (FIG. 1), in the paper transit area for the paper P, the frictional force $f_2$ exerts in a direction of moving the fusing belt 11 through the paper P between the mold-releasing layer 11*a* of the fusing belt 11 and a surface of the paper P while in the non-paper transit area for the paper P, the frictional force, $f_4$, $f_4'$ exert in a direction of directly moving the fusing belt 11 between the outer circumferential surface of the pressure roller 12 and the elastic layer 11*b* of the fusing belt 11.

Therefore, the fusing roller 11 is driven to move in a direction of the arrow a upon a resultant force of the frictional force $f_2$, $f_4$, $f_4'$, i.e., $f_2+f_4+f_4'$. In this bout, the frictional force $f_1$ exerts between the inner circumferential surface of the fusing belt 11 and the contact surface of the pushing member 13, in a direction of preventing the fusing belt 11 from moving, so that the resultant force of $f_2+f_4+f_4'$ needed to be greater than the frictional force $f_1$ to move the fusing belt 11 smoothly.

Furthermore, since the mold-releasing layer 12*c* made of the PFT is formed on the outer circumferential surface of the pressure roller 12 to enhance the mold releasing property and the durability, the frictional force $f_3$ exerting between the outer circumferential surface of the pressure roller 12 and the back-surface of the paper P, in a paper conveyance direction comes to be approximately equal to the frictional force $f_2$. Furthermore, even if the paper P having the small friction coefficient is used, the frictional force $f_2$ reduces and the frictional force $f_3$ reduces as well, and therefore relational expression of $f_2<f_1<f_2+f_4+f_4'$ needs to be satisfied with respect to each of the frictional force $f_1$, $f_2$, $f_4$, $f_4'$ so that the fusing belt 11 moves smoothly to convey the paper P smoothly without depending on the friction coefficient of the paper P.

Where the frictional force $f_2$ is approximated to zero with the above relational expression, an expression $f_2<f_1<f_4+f_4'$ ($f_2$ is nearly equal to zero) is to be satisfied, so that the fusing belt 11 can be moved smoothly to convey the paper P smoothly.

Herein, as shown in FIG. 8, where the friction coefficient of the contact surface of the pushing member 13 is set to $\mu_1$, the friction coefficient of the inner circumferential surface (a surface of a heating side) of the fusing belt 11 is set to $\mu_i$, the friction coefficient of the mold-releasing layer 11*a* on the outer circumferential surface (an opposing surface to the heating side) of the fusing belt 11 is set to $\mu_{01}$, the friction coefficient of the elastic layer 11*b* is set to $\mu_{02}$, the friction coefficient of the surface of the paper P is set to $\mu_2$, the friction coefficient of the back-surface of the paper P is set to $\mu_3$, and the outer circumferential surface of the pressure roller 12 is set to $\mu_4$, the surface layer 13*c* is formed on the contact surface of the pushing member 13 in this embodiment, so that an expression of $\mu_1=\mu_{01}=\mu_4$ is satisfied. Furthermore, where the friction coefficients $\mu_2$, $\mu_3$ are equal to the friction coefficient $\mu_1$ of the contact surface (in this case, the friction coefficients $\mu_2$, $\mu_3$, $\mu_1$ are smaller than the friction coefficient of, e.g., the OHP paper, a coated paper, or the like), an expression of $\mu_i=\mu_{01}=\mu_2=\mu_3=\mu_4$ is satisfied, and the relation among the above described frictional force can be expressed by the friction coefficients.

That is, where the nipping width is set to n, when a pressing force applied to "the nipping width n×the total length L of the fusing belt 11" is set to F, a pressing force applied to "the nipping width n×the mold-releasing layer width $L_1$" is set to $F_1$, and pressing forces applied to "the nipping width n×the elastic layer exposed widths $L_2$," and to "the nipping width n×the elastic layer exposed width $L_2$" are respectively set to $F_2$ and $F_2'$, the expression of $\mu_{01}\cdot F_1<\mu_i F<\mu_{01}\cdot F_1+\mu_{02}(F_2+F_2')$, $F=F_1+F_2+F_2'$ is satisfied.

Herein, the pressing forces F, $F_1$, $F_2$, $F_2'$ respectively applied to the surface of each member are proportional to the total length L, the mold-releasing layer width $L_1$, and the elastic layer exposed widths $L_2$, $L_2'$, so that the expression f $\mu_{01}\cdot L_1<\mu_i L<\mu_{01}\cdot L_1+\mu_{02}(F_2+F_2')$ is satisfied.

In this embodiment, the friction coefficient of the PFT is of 0.2: the friction coefficient of the stainless steel is of 0.3, the friction coefficient of the silicone rubber is of 0.9, the total length L is of 450 [mm], the mold-releasing layer width $L_1$ is of 336 [mm], and the elastic layer exposed widths $L_2$, $L_2'$ are of 57 [mm]. Therefore, the above described relation is set.

Furthermore, on the fusing belt 11, a material for each of the base material 11*c*, the mold-releasing layer 11*a*, and the elastic layer 11*b* is selected so the friction coefficients $\mu_i$, $\mu_{01}$, $\mu_{02}$ to form the expression of $\mu_{01}<\mu_i<\mu_{01}$. In this case, it is to be noted that the friction coefficients $\mu_i$, $\mu_{01}$, $\mu_2$ can be adjusted upon selecting a single material or upon combining a plurality of materials.

As described above, in this embodiment, even where the frictional force $f_2$ is reduced upon using the paper P having small friction coefficients $\mu_2$, $\mu_3$, or even where the frictional force $f_3$ is reduced upon the pressure roller 12 having the mold releasing property, the moving force expressing force for moving the fusing belt 11 and the conveyance force expressing force for conveying the paper P can be increased upon rendering the frictional force $f_4+f_4'$ larger.

When the friction coefficients $\mu_2$, $\mu_3$ of the paper P become larger, the expression of $f_2>f_1$ is occasionally satisfied with respect to the frictional force $f_1$, $f_2$, however, in this case also, the expression of $f_1<f_4+f_4'$ is satisfied with respect to the frictional force $f_1$, $f_4$, $f_4'$, so that the fusing belt 11 can be smoothly moved to convey the paper P smoothly.

Even where the friction coefficient $f_1$ is increased with the pushing member 13, the moving force for the fusing belt 11 and the conveyance force for the paper P can be maintained upon changing increasing the friction coefficient $\mu_{02}$ or upon widening the elastic layer exposed widths $L_2$, $L_2'$ by changing the material of the elastic layer 11*b*.

As described above, in this embodiment, since the mold-releasing layer 11*a* is formed on the fusing belt 11 while the mold-releasing layer 12*c* is formed on the pressure roller 12, over long periods, the outer circumferential surfaces of the fusing belt 11 and the pressure roller 12 does not become dirty, the stable mold releasing property and the durability can be maintained, and the fusing belt 11 can be smoothly moved to convey the paper P smoothly. As a result, the slip between the paper P transiting through the nipping portion N and the fusing belt 11 or the pressure roller 12 can be prevented from occurring, so that the image quality can be improved.

Furthermore, the outer circumferential surface of the pressure roller 12 is covered with the tube as the mold-releasing layer 12*c*, so that the rotating speed can be prevented from changing upon reducing a thermal expansion amount by applying a stress to the pressure roller 12 from the outside. Thus, the paper P can be stably conveyed.

Since the friction coefficient of the fusing belt 11 can be increased only upon exposing a part of the elastic layer 11*b* of the fusing belt 11, other members or processes do not need to be added, so that a cost for the fusing device 30 can be rendered low.

In the meantime, this invention can be applied to the fusing device in which the fusing belt is disposed as stretched among a plurality of the members, such as the pushing member, the tension roller, or the like. It is to be noted that members structured the same as the fusing device shown in FIG. 4 are assigned with the same numerals to omit the duplicated explanation.

Figure 9:
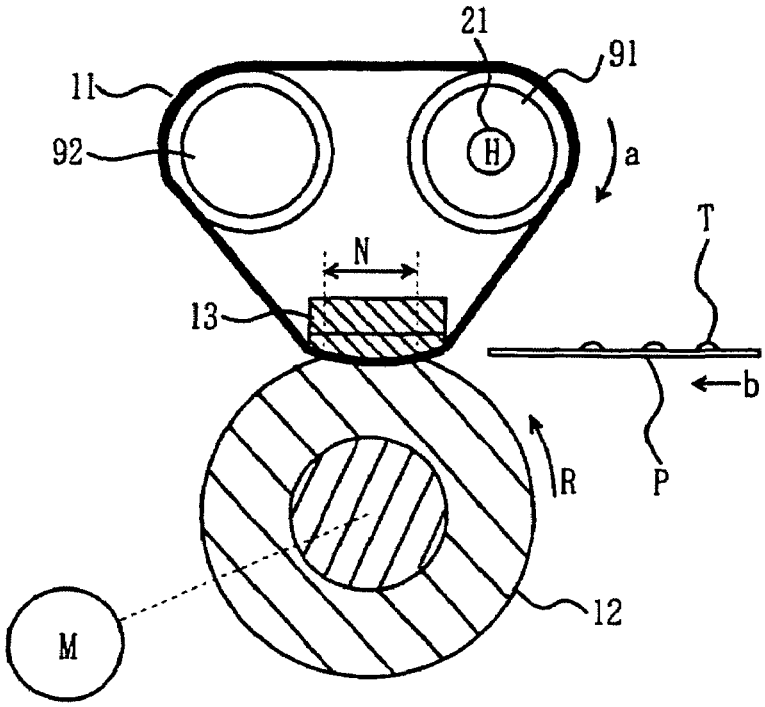
FIG. 9 is a cross-sectional view showing an essential part of the fusing device of another type according to the first embodiment of this invention.

FIG. 9 is a cross-sectional view showing an essential part of the fusing device of another type according to the first embodiment of this invention.

In that case, the fusing belt 11 is disposed as stretched among the pushing member 13, a fusing roller 91 serving as the first roller, and a tension roller 92 serving as the second roller, in which the halogen lamp 21 is disposed inside the fusing roller 91. It is to be noted that alphabet M is the motor while alphabet T is the toner image.

Figure 10:
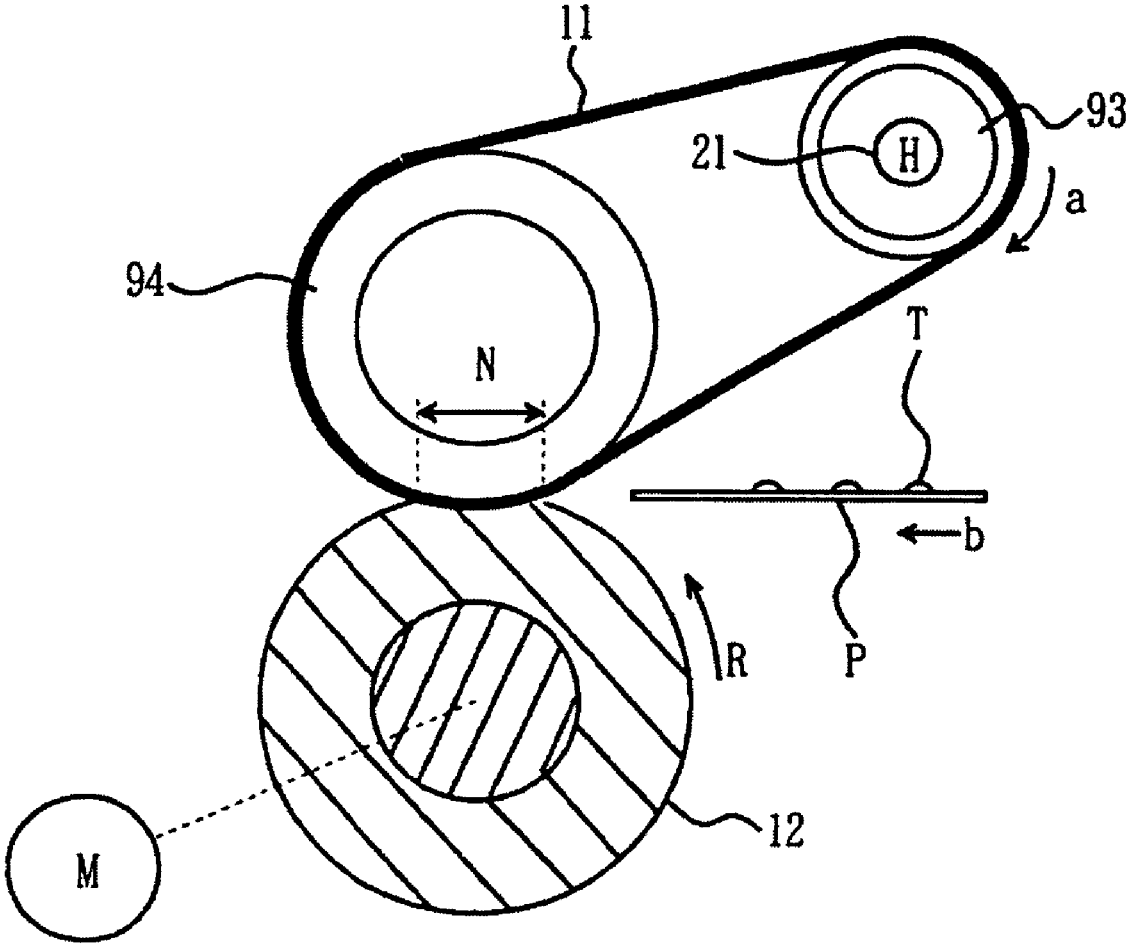
FIG. 10 is a cross-sectional view showing the fusing device further another type according to the first embodiment of this invention.

FIG. 10 is a cross-sectional view showing the fusing device of further another type according to the first embodiment of this invention.

In that case, the fusing belt 11 is disposed as stretched among the plurality of, e.g., between two tension rollers, i.e., a first tension roller 93 and a second tension roller 94, in which the halogen lamp 21 is disposed inside the first tension roller 93. The second tension roller 94 is pushed onto the pressure roller 12 through the fusing belt 11.

The second embodiment of this invention is described next. It is to be noted that members structured the same as in the first embodiment are assigned with the same numerals to omit the duplicated explanation, and the advantages of this invention are applicable to the second embodiment because of the same structure as the first embodiment.

Figure 11:
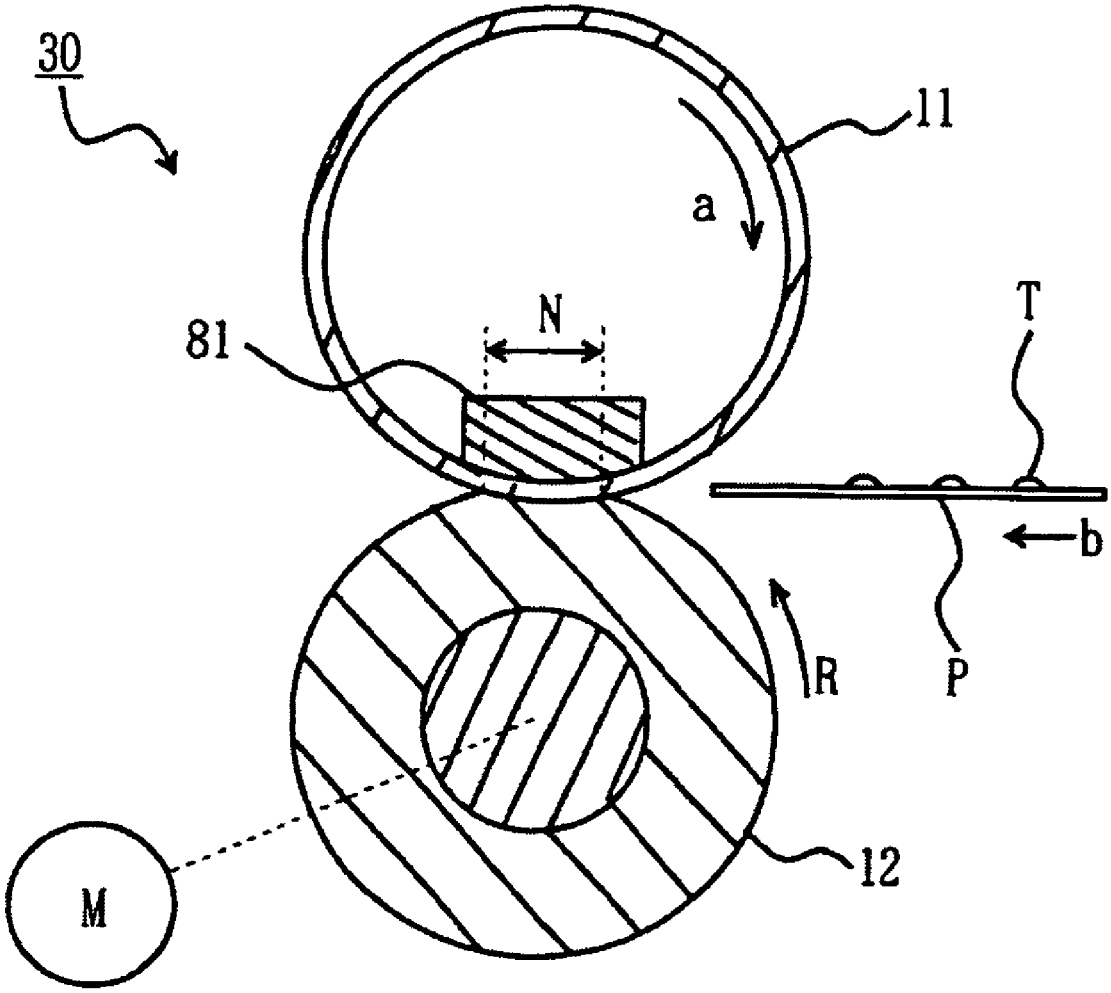
FIG. 11 is a cross-sectional view showing an essential part of a fusing device according to the second embodiment of this invention.

FIG. 11 is a cross-sectional view showing an essential part of a fusing device according to the second embodiment of this invention.

In FIG. 11, numeral 81 is a pushing member in which a ceramic heater, not shown, serving as a heating source, disposed in a longitudinal direction, composed of a heating body in a line form having a low thermal capacity is formed on an alumina substrate made of ceramic having high thermal conductivity. It is to be noted that the ceramic heater is formed upon coating an electric heating resistance material in a band manner, and composes a heat generating body layer.

The second embodiment is described next. It is to be noted that that members structured the same as in the first embodiment are assigned with the same numerals to omit the duplicated explanation, and the advantages of this invention are applicable to the second embodiment because of the same structure as the first embodiment.

Figure 12:
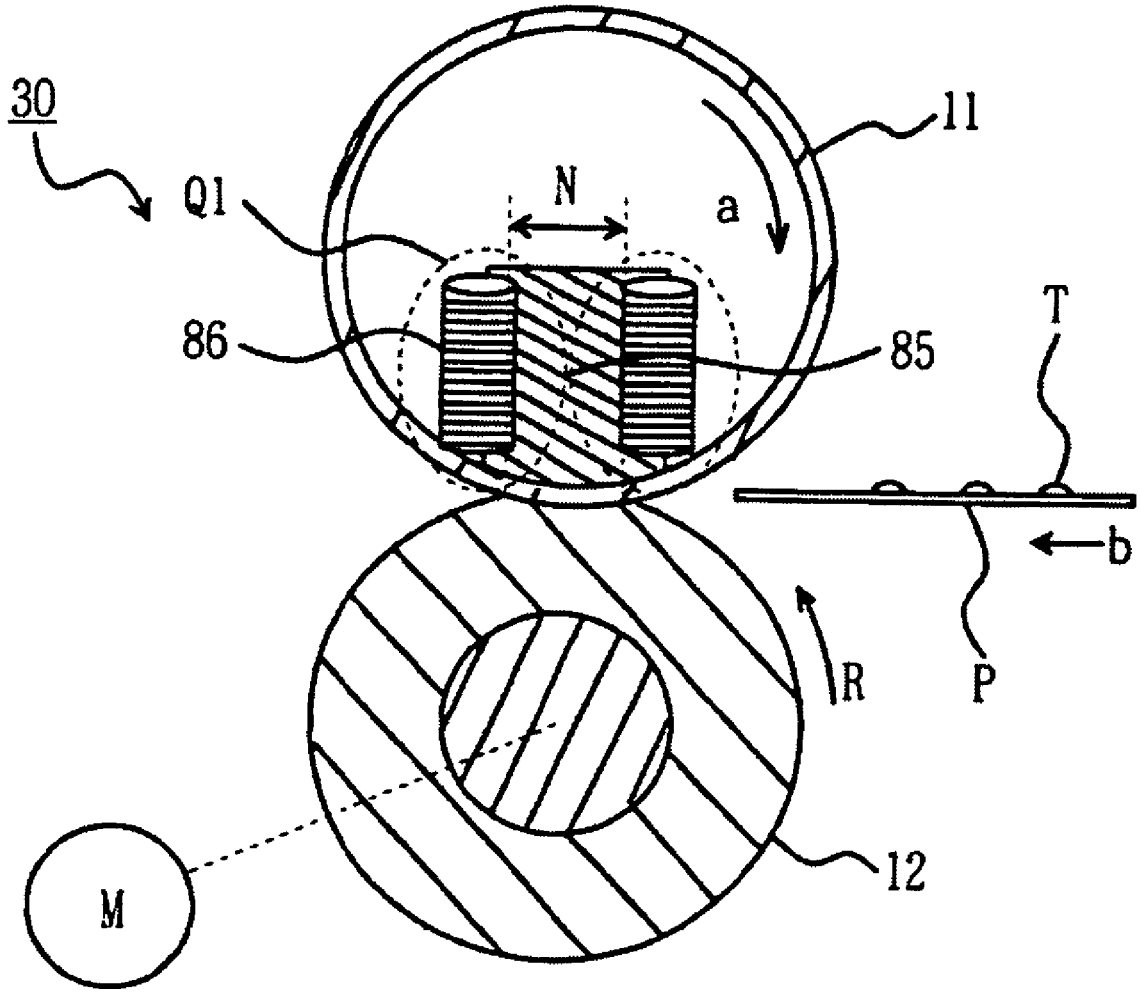
FIG. 12 is a cross-sectional view showing an essential part of a fusing device according to the third embodiment of this invention.

FIG. 12 is a cross-sectional view showing an essential part of a fusing device according to the third embodiment of this invention.

In FIG. 12, numeral 85 is a core while numeral 86 is a coil, and the base material 11*c* (FIG. 5) of the fusing belt 11 is, as described above, made of the electrically conductive metal having a strong magnetism, such as, e.g., nickel, iron, stainless steel, nickel-cobalt alloy, or the like. Therefore, when electric current of a prescribed amount is applied to the coil 86, magnetic field Q1 is formed, and over-current occurs in the base material 11*c* of the fusing belt 11 as the belt, so that with Joule heat, the basic material 11*c* generates heat to be heated.

In that case, it is to be noted that the heating source is composed of the basic material 11*c* and the coil 86. Furthermore, the basic material 11*c* may be formed of a resin having high thermal resistance, added with the electrically conductive metal having strong magnetism, i.e., the heat-resisting resin, such as e.g., a polyimide. The elastic layer 11*b* may be added with the electrically conductive metal having strong magnetism.

In the meantime, in the first embodiment, in order to increase the friction coefficient $\mu_{02}$ of the non-transit area for the paper P on the outer circumferential surface of the fusing belt 11, the mold-releasing layer 11*a* is formed as shorter than the total length L of the fusing belt 11 to expose the elastic layer 11*b*. However, when the elastic layer exposed widths $L_2$, $L_2'$ are rendered larger, the printer undesirably becomes larger in size.

Thus, the fourth embodiment of this invention is described, in which the printer can be downsized. It is to be noted that a structure of the fusing device in this embodiment is the same as that of the fusing device 30 in the first embodiment, thereby explained upon application of FIG. 1.

In that case, the fusing belt 11 having the total length L of 404 [mm] is used as the belt. With respect to the maximum paper transit width $L_0$ of 330 [mm], the mold-releasing layer width $L_1$ of 336 [mm] is formed, in which a margin composed of a distance of 3 [mm] is placed on each of the left and right sides, while the elastic layer exposed widths $L_2$, $L_2'$ of 34 [mm] are respectively formed next to the left and right sides. Therefore, the total length L of the fusing belt 11 is determined by expression, $L=L_1+L_2+L_2'=336+57\times2=450$ [mm].

The frictional force occurring during the paper transit in thus structured fusing device 30 is described next.

When the paper P serving as the recording medium is conveyed in the direction of the arrow b through the nipping portion N, as shown in FIG. 7, the frictional force $f_2$ exerts between the mold-releasing layer 11*a* of the fusing belt 11 and the surface of the paper P in the paper transit area for the paper P, while the frictional force, $f_4$, $f_4'$ exert between the outer circumferential surface of the pressure roller 12 and the elastic layer 11*b* of the fusing belt 11 in the non-paper transit area for the paper P.

Therefore, the fusing roller 11 is driven to move in a direction of the arrow a upon a resultant force of the frictional force $f_2$, $f_4$, $f_4'$, i.e., $f_2+f_4+f_4'$. In this bout, the frictional force $f_1$ exerts between the inner circumferential surface of the fusing belt 11 and the contact surface of the pushing member 13, so that the resultant force of $f_2+f_4+f_4'$ needed to be greater than the frictional force $f_1$ to move the fusing belt 11 smoothly.

Furthermore, since the mold-releasing layer 12*c* made of the PFT is formed on the pressure roller 12 to enhance the mold releasing property and the durability, the frictional force $f_3$ exerting between the outer circumferential surface of the pressure roller 12 and the back-surface of the paper P comes to be approximately equal to the frictional force $f_2$. Furthermore, where the paper P having the small friction coefficient is used, the frictional force $f_2$ reduces and the frictional force $f_3$ reduces as well.

Thus, relational expression of $f_1<f_2<f_2+f_4+f_4'$ needs to be satisfied with respect to each of the frictional force $f_1$, $f_2$, $f_4$, $f_4'$ so that the fusing belt 11 moves smoothly to convey the paper P smoothly without depending on the friction coefficient of the paper P.

Herein, as shown in FIG. 8, where the friction coefficient of the contact surface of the pushing member 13 is set to $\mu_1$, the friction coefficient of the inner circumferential surface of the fusing belt 11 is set to $\mu_i$, the friction coefficient of the mold-releasing layer 11*a* is set to $\mu_{01}$, the friction coefficient of the elastic layer 11*b* is set to $\mu_{02}$, the friction coefficient of the surface of the paper P is set to $\mu_2$, the friction coefficient of the back side of the paper P is set to $\mu_3$, and the outer circumferential surface of the pressure roller 12 is set to $\mu_4$, in this embodiment, the surface layer 13*c* is formed on the contact surface of the pushing member 13, so that the relation expression of $\mu_1=\mu_{01}=\mu_4$ is satisfied. Furthermore, where the friction coefficients $\mu_2$, $\mu_3$ are equal to the friction coefficient $\mu_1$ of the contact surface (the friction coefficients $\mu_2$ of the surface of the paper P, at a side of the fusing belt 11 is smaller than the friction coefficient of, e.g., the OHP paper, the coated paper, or the like), the expression of $\mu_1=\mu_{01}=\mu_2=\mu_3=\mu_4$ is satisfied, and the relation among the above described frictional force can be expressed by the friction coefficients.

That is, where the nipping width is set to n, when a pressing force applied to "the nipping width n×the total length L of the fusing belt 11" is set to F, a pressing force applied to "the nipping width n×the mold-releasing layer width $L_1$" is set to $F_1$, and pressing forces applied to "the nipping width n×the elastic layer exposed widths $L_2$," and to "the nipping width n×the elastic layer exposed width $L_2$" are respectively set to $F_2$ and $F_2'$, the expression of $\mu_{01}\cdot F_1<\mu_i F<\mu_{01}\cdot F_1+\mu_{02}(F_2+F_2')$, $F=F_1+F_2+F_2'$ is satisfied.

Herein, the pressing forces F, $F_1$, $F_2$, $F_2'$ applied to the surface of each member are proportional to the total length L, the mold-releasing layer width $L_1$, and the elastic layer exposed widths $L_2$, $L_2'$, so that the expression f $\mu_{01}\cdot L_1<\mu_i L<\mu_{01}\cdot L_1+\mu_{02}(F_2+F_2')$ is satisfied.

In this embodiment, the friction coefficient of the PFT is of 0.2: the friction coefficient of the stainless steel is of 0.3, the friction coefficient of the silicone rubber is of 0.9, the total length L is of 404 [mm], the mold-releasing layer width $L_1$ is of 336 [mm], and the elastic layer exposed widths $L_2$, $L_2'$ are of 34 [mm]. Therefore, the above described relation is set.

In this situation, on the fusing belt 11, an expression of $L=L_1+L_2+L_2'$ is satisfied, so that $(\mu_i-\mu_{01})\times L_1/(\mu_{02}-\mu_i)<L_2+L_2'$ can be set to express the fusing belt 11.

As described above, in this embodiment, even where the frictional force $f_2$ is reduced upon using the paper P having small friction coefficients $\mu_2$, $\mu_3$, or even where the frictional force $f_3$ is reduced upon using the pressure roller 12 having high mold releasing property, the conveyance force for conveying the paper P can be increased upon rendering the frictional force $f_4$, $f_4'$ larger.

Even where the friction coefficients $\mu_2$, $\mu_3$ become smaller to satisfy the expression of $f_2<f_1$, the expression of $f_1<f_2+f_4+f_4'$ is satisfied, so that the fusing belt 11 can be smoothly moved to convey the paper P smoothly. Furthermore, where the friction coefficients $\mu_2$, $\mu_3$ become larger, the expression of $f_2>f_1$ is occasionally satisfied, however, in this case also, the expression of $f_1<f_2+f_4+f_4'$ is satisfied, so that the fusing belt 11 can be smoothly moved to convey the paper P smoothly.

Even where the frictional force becomes larger, the moving force for the fusing belt 11 and the conveyance force for the paper P can be maintained upon setting the friction coefficient $\mu_{02}$ and the elastic layer exposed widths $L_2$, $L_2'$ so the above described relation is set.

As described above, in this embodiment, with respect to the summation of the frictional coefficients, $\mu_i$, $\mu_{02}$, $\mu_{03}$, an expression of $(\mu_i-\mu_{01})\times L_1/(\mu_{02}-\mu_i)<L_2+L_2'$ is satisfied, so that the fusing device 30 can be downsized.

In the meantime, in each of the above described embodiments, on the fusing device 30, the flange members 31, 32 serving as the guide, formed of, e.g., the resin having high thermal resistance and sliding property are disposed to restrict the fusing belt 11 from sidling upon shifting in a direction perpendicular to a moving direction. The flange members 31, 32 have a structure in which the flange members 31, 32 are rendered in contact with the fusing belt 11 to prevent the slide when the sidle occurs on the fusing belt 11. However, the fusing belt 11 is formed upon forming the elastic layer 11*b* on the outer circumferential surface of the endless base member 11*c* made of the electrically conductive metal and thereafter forming the mold-releasing layer 11*a* on the elastic layer 11*b*, so that the when an edge portion of the fusing belt 11 slides, in accordance with sidling, on the flange members 31, 32, the flange members 31, 32 are scraped off, thereby undesirably deteriorating the durability of the fusing device 30.

Figure 13:
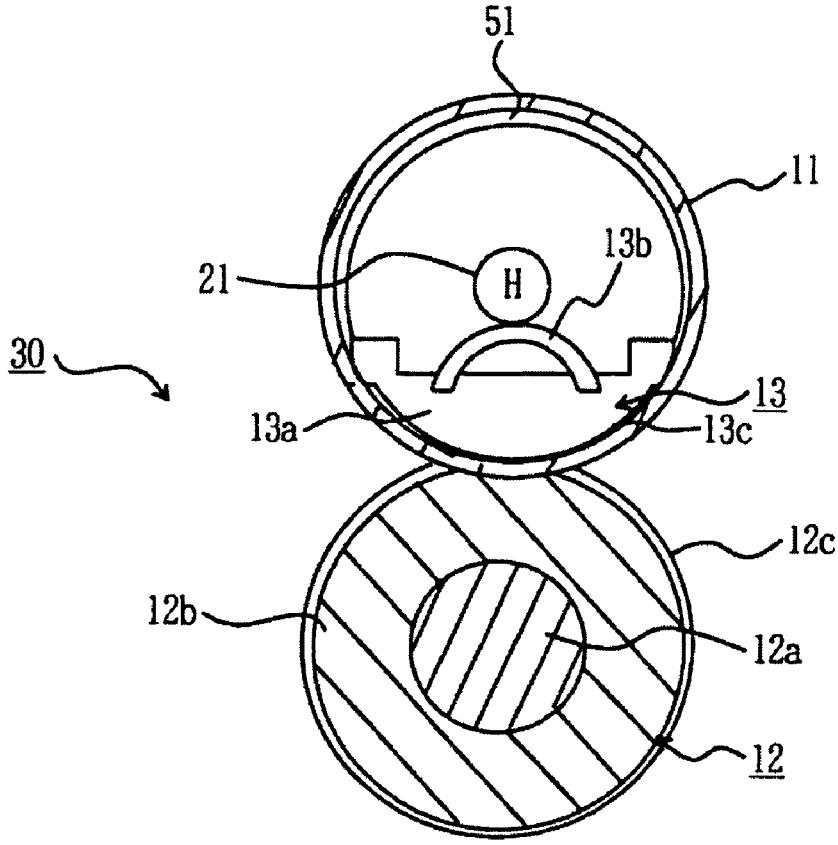
FIG. 13 is a cross-sectional view showing an essential part of a fusing device of a belt type according to the fifth embodiment of this invention.
Figure 14:
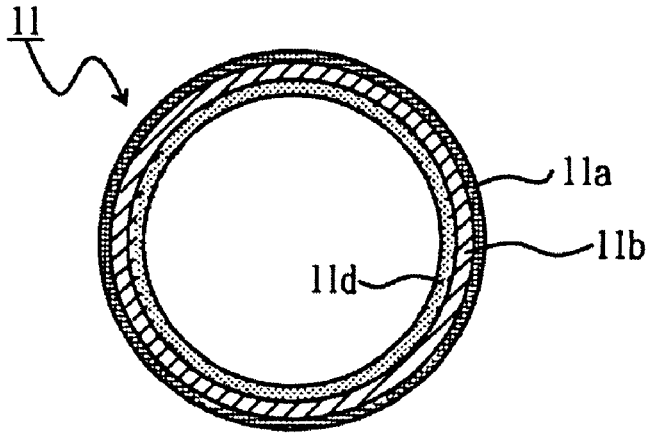
FIG. 14 is a cross-sectional view showing a fusing belt according to the fifth embodiment of this invention.

FIG. 13 is a cross-sectional view showing an essential part of a fusing device of a belt type according to the fifth embodiment of this invention, and FIG. 14 is a cross-sectional view showing a fusing belt according to the fifth embodiment of this invention.

As shown in the drawings, the base material 11*d* of the fusing belt 11 is formed of the heat-resisting resin, while a polyimide, the polyamidide, a polyether ketone, or the like is used as the heat-resisting resin. The thickness of the base material 11*d* is desirably rendered of 30 to 100 [μm] in view of balance between thermal conduction and strength. Furthermore, the elastic layer 11*b* is formed of heat-resisting rubber such as, e.g., the fluoric rubber or the like, and rendered to have a thickness of 100 to 1000 [μm] to obtain uniformity on the image. The mold-releasing layer 11*a* is formed of the fluoric resin having high thermal resistance and durability, or the like, and covered with the elastic layer 11*b*.

In this embodiment, the polyimide having an inner diameter of 35 [mm] and a layer thickness of 70 [μm] is used as the base material 11*d*, and the elastic layer is formed upon rendering the silicone rubber in a liquid form having a rubber strength of 20 degrees (ASKER-C) have a layer thickness of 160 [μm], and the mold-releasing layer 11*a* is formed upon covered the tube made of PFA having a thickness of 30 [μm] so that the fusing belt 11 is formed in which an outside dimension is such that a total thickness including the primer layer is of approximate 270 [μm] and a total length is of 450 [μm].

Numeral 51 is a metal thin plate member serving as the guiding member, made of material having high thermal conductivity and thermal resistance, e.g., in this embodiment, metal material, and the metal thin plate member 51 has a shape in a circular form, and is disposed to above the pushing member 13, along with the inner circumferential surface of the fusing belt 11, in which each end of the metal thin plate member 51 is fastened with the pushing member 13. It is to be noted that in this embodiment, the metal thin plate member 51 is formed of the stainless steel having a thickness of 0.8 [mm], and the halogen lamp 21 as the heating source is disposed inside the metal thin plate member 51. The metal thin plate member 51 guides the fusing belt 11 while conducting the heat from the halogen lamp 21 to the fusing belt 11.

Operation of the fusing device 30 is next described.

The rotation is transmitted from the motor M (FIG. 1) to the pressure roller 12 serving as the pressure member, thereby rotating the pressure roller 12 at a prescribed rotating speed. Accordingly, the frictional force exerting between the outer circumferential surface of the pressure roller 12 and the outer circumferential surface of the fusing belt 11 at the nipping portion N renders the fusing belt 11 be in a rotating state in which the fusing belt 11 is driven to rotate along with the metal thin plate member 51. That is, the fusing belt 11 is moved at a speed approximately equal to the rotating speed of the pressure roller 12, with the inner circumferential surface of the fusing belt 11 sliding as in a closely contact with the contact surfaces of the metal thin plate member 15 and the pushing member 13

During the above operation, the fusing belt 11 is guided with the metal thin plate member 51 heated with the halogen lamp 21, and heated with the conducted heat during guided, likewise the first embodiment, so that the same fusing process as that in the first embodiment is implemented.

In this embodiment, even especially when the fusing device 30 is irregularly stopped for some reasons and the halogen lamp 21 happens to go out of control, the fusing belt 11 can be prevented from getting damaged since the metal thin plate member 51 is disposed between the fusing belt 11 and the halogen lamp 21. It is to be noted the frictional force $f_1$ exerts between the inner circumferential surface of the fusing belt 11 an the contact surfaces of the metal thin plate member 51 and the pushing member 13, in a direction of preventing the fusing belt 11 from moving, however, likewise the first embodiment, on the fusing belt 11, the mold-releasing layer 11*a* is not formed at the non-transit area to expose the elastic layer 11*b*, so that the frictional force $f_4$, $f_4'$ exert between the outer circumferential surface of the pressure roller 12 and the elastic layer 11*b* of the fusing belt 11, in a direction of moving directly the fusing belt 11. As a result, the moving force for the fusing belt 11 and the conveyance force for the paper P can be maintained.

As described above, in this embodiment, since the heat-resisting resin is used for the base material 11*d* of the fusing belt 11, the flange members 31, 32 serving as the guiding member are not scrapped off in accordance of the moving of the fusing belt 11, so that the durability of the fusing device 30 can be improved.

It is to be noted that in this embodiment, since the heat resisting resin having elasticity is used for the base material 11*d*, bending stress applied to the fusing belt 11 can be reduced, however, because of the heat-resisting resin having the elasticity, the fusing belt has difficulty moving with maintaining the circular shape thereof when rendered to moved at high speed, so that the fusing belt 11 undesirably swings, thereby sidling up to the flange members 31, 32. Thus, it is desirable to dispose the metal thin plate member 51 with a prescribed interval to the fusing belt 11. In that case, even where rendered to move at high speed, the fusing belt 11 can move with maintaining the circular shape thereof while prevented from swing and sidling up to the flange members 31, 32.

In the meanwhile, in the fifth embodiment, when the fusing is implemented at high speed or the fusing device 30 is started quickly, the thermal conductivity from the metal thin plate member 51 to the basic material 11*d* needs to be enhanced, and therefore the tension on the fusing device 11 caused by the metal thin plate member 51 needs to be increased since. In this case, the frictional force $f_1'$ interfering with the conveyance of the fusing belt 11 becomes larger due to the tension, so that the elastic layer exposed widths $L_2$, $L_2'$ need to be wider by that much.

The sixth embodiment of this invention is therefore described.

In this case, on the fusing belt 11, the heat-resisting resin such as, e.g., a polyimide, the polyamidide, the polyether ketone, or the like, composing the base material 11*d* is added with the fluoric resin such as, e.g., the PFA, the PTEF, or the like. A mixing ratio between the fluoric resin and the heat-resisting resin is desirably set to 5 to 25 parts by weight of the fluoric resin in proportion to 100 parts by weight of the heat-resisting resin. It is to be noted that the outer diameter, thickness, or the like of the base material 11*d* as well as the material, the thicknesses, or the like of the elastic layer 11*b* and the mold-releasing layer 11*a* are the same as those in the fifth embodiment.

The metal thin plate member 51 is disposed as adding the tension to the fusing belt 11. Therefore, an outer diameter of a circular portion composed of an outer circumferential surfaces of the pushing member 13 and the metal thin plate member 51 is rendered approximately equal to or slightly smaller than the inner diameter of the fusing belt 11. The other structures are the same as the those in the first embodiment. In this embodiment, the base material 11*d* is formed upon adding 15 parts by weight of the PTFE in proportion to 100 parts by weight of the polyimide. It is to be noted that a coating layer may be formed on a side of the contact surface on the metal thin plate member 51, in contact with the fusing belt 11.

In that case, the PTFE added to the polyimide composing the base material 11*d* renders the friction coefficient be of 0.3 to 0.1, compared with a case where the PTFE is not added. It is to be noted that the plurality of the PTFE are dispersed within the polyimide, so that the friction coefficient does not change even where the base material 11 is abraded away. It is therefore possible to prevent increase of the frictional force $f_1$ which exerts between the inner circumferential surface of the fusing belt 11 and the outer circumferential surface of the metal plate thin member 51 while preventing the conveyance of the fusing belt 11 upon application of the tension, and therefore there is not only no need to widen the elastic layer exposed widths $L_2$, $L_2'$, but the durability of the fusing device 30 can be improved, so that the fusing belt 11 can be stably moved.

In the meantime, when a boundary of a portion where the elastic layer 11 is exposed, i.e., each of the edges of the mold-releasing layer 11*a* comes off and is worn off in accordance with repetitive printing, the elastic layer 11*b* is exposed at a portion originally set as the mold-releasing layer 11*a*, and the toner, the paper dusts, or the like is undesirably attached to the above exposed elastic layer 11*b*. Thus, the seventh embodiment of this invention is described, in which the elastic layer 11*b* is not exposed at a portion originally set as the mold-releasing layer 11*a*.

Figure 15:
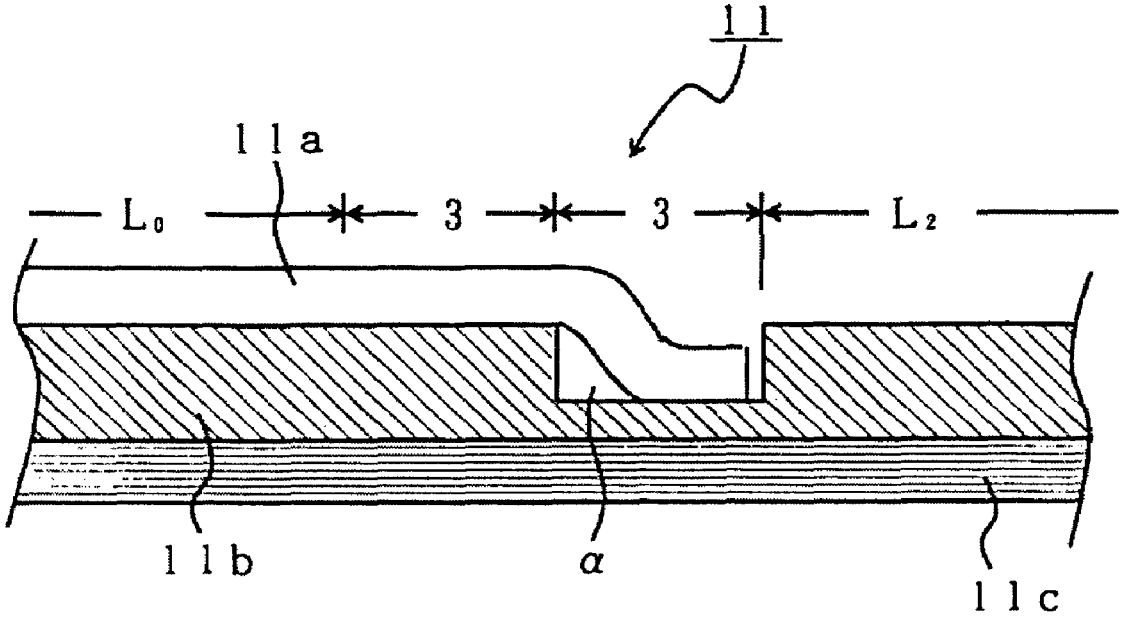
FIG. 15 is a cross-sectional view showing an essential part of a fusing device according to the seventh embodiment of this invention.

FIG. 15 is a cross-sectional view showing an essential part of a fusing device according to the seventh embodiment of this invention.

In this case, the strong magnetic stainless steel having an inner diameter of 35 [mm] and a thickness of 40 [μm] is used as the base material 11*c*, the elastic layer 11*b* is formed upon forming the silicone rubber in a liquid form having a rubber strength of 20 degrees (ASKER-C) so as to have a layer thickness of 200 [μm], and the mold-releasing layer 11*a* is formed upon covered with the tube made of PFA having a thickness of 30 [μm] so that the fusing belt 11 is formed, in which an outside dimension is such that a total thickness including the primer layer is of approximate 270 [μm] and a total length is of 450 [μm].

In the meanwhile, in this embodiment, the elastic layer 11*b* is exposed in the non-transit area, and an escaping portion α composed of a groove is formed between the maximum paper transit width $L_0$ and the elastic layer exposed widths $L_2$, $L_2'$.

That is, with respect to the maximum paper transit width $L_0$ of 330 [mm], the mold-releasing layer width $L_1$ of practically 336 [mm] is formed, in which the margin composed of a distance of 3 [mm] is placed on each of the left and right sides while the escaping portion a having a width of 3 [mm] and a diameter smaller by 100 to 150 [μm] than the outer diameter of the fusing belt 11 is formed at each of outsides of the left and right sides, in which the elastic layer exposed widths $L_2$, $L_2$ of 54 [mm] are respectively formed to the outsides of the escaping portion α.

In that case, the end portion of the mold-releasing layer 11*a* is placed inside each of the escaping portions α, thereby being able to prevent each of the edges of the mold-releasing layer 11*a* from, e.g., coming off and worn off.

In the meantime, in each of the above described embodiments, the elastic layer 11*b* is exposed to form the range rendered to have a large frictional force, but the friction coefficient of the surface of the heat-resisting rubber such as, e.g., silicone rubber or the like, composing the elastic layer 11*b* is reduced upon heated. Therefore, under heated condition, the conveyance force of the fusing belt 11 for conveying the paper P (FIG. 7) serving as the recording medium is undesirably reduced.

The eighth embodiment of this invention is next described, in which the conveyance force of the fusing belt 11 for the paper P can be prevented from reduced under heated condition.

Figure 16:
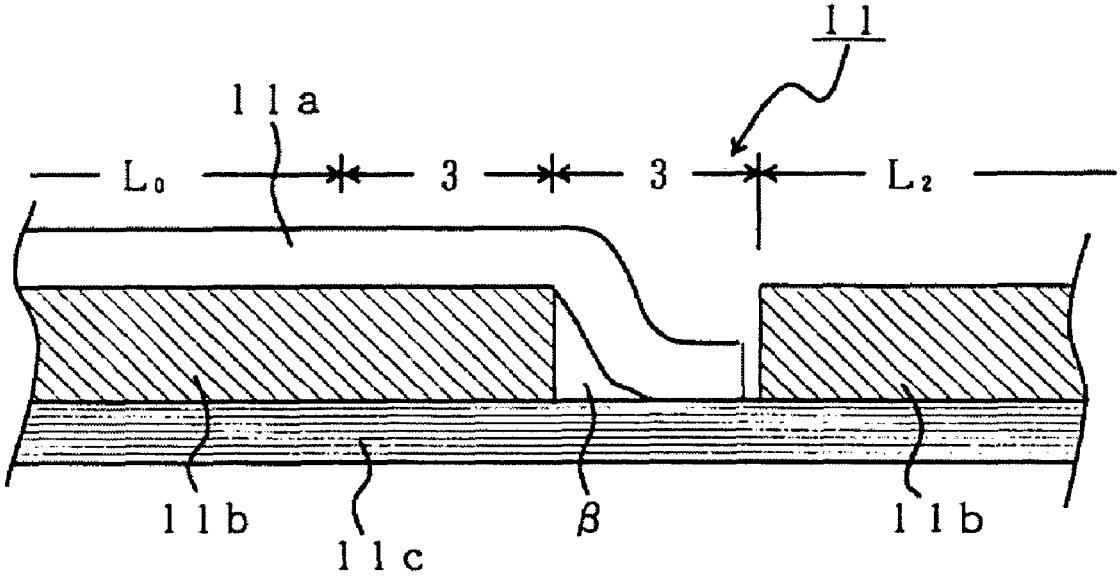
FIG. 16 is a cross-sectional view showing an essential part of a fusing belt according to the eighth embodiment of this invention.

FIG. 16 is a cross-sectional view showing an essential part of a fusing belt according to the eighth embodiment of this invention.

In this case, the elastic layer 11*b* is exposed in the non-transit area, and the base material 11*c* is exposed between the maximum paper transit width $L_0$ and the elastic layer exposed widths $L_2$, $L_2'$ to form an escaping portion β.

In the meantime, a thermal conductivity of the primer layer coated to form the elastic layer 11*b* outside the escaping portion β is rendered lower than that of the primer layer coated to form the elastic layer 11*b* inside the escaping portion β. Furthermore, the elastic layer 11*b* outside the escaping portion β is added with 5 to 25 parts by weight of the resin having the high durability and friction coefficient, such as, e.g., a PEEK(polyether ether ketone), a PPS(polyphenyl sulfide), or the like in proportion to 100 parts by weight of the silicone rubber.

That is, with respect to the maximum paper transit width $L_0$ of 330 [mm], the mold-releasing layer width $L_1$ of practically 336 [mm] is formed, in which the margin composed of a distance of 3 [mm] is placed on each of the left and right sides while not the elastic layer of 3 [mm] but the escaping portion β where the base material 11*c* is exposed is formed at each of outsides of the left and right sides, in which the mold-releasing layer 11*a* is practically formed between each of the escaping portions β. It is to be noted that the elastic layer 11*b* outside the escaping portion β is added with 15 parts by weights of the PEEK in proportion to 100 parts by weight of the silicone rubber.

In that case, the elastic layer 11*b* inside the escaping portion β is separated from the elastic layer 11*b* outside the escaping portion β, so that the heat can be prevented from conducting from the elastic layer 11*b* inside the escaping portion β to the elastic layer outside the escaping portion β. Furthermore, since the thermal conductivity of the primer layer outside the escaping portion β is rendered small, the heat can be prevented from conducting from the base material 11*c* to the elastic layer 11*b* outside the escaping portion β.

Furthermore, the friction coefficient of the elastic layer 11*b* outside escaping portion β is rendered larger than that of the elastic layer 11*b* inside escaping portion β. As a result, the friction coefficient of the elastic layer exposed widths $L_2$, $L_2'$ can be stably maintained in large amounts, so that the conveyance force of the fusing belt 11 for the paper P (FIG. 7) as the recording medium can be greatened.

The ninth embodiment of this invention is next described. It is to be noted that members structured the same as in the first embodiment are assigned with the same numerals to omit the duplicated explanation, and the advantages of this invention are applicable to the second embodiment because of the same structure as the first embodiment.

Figure 17:
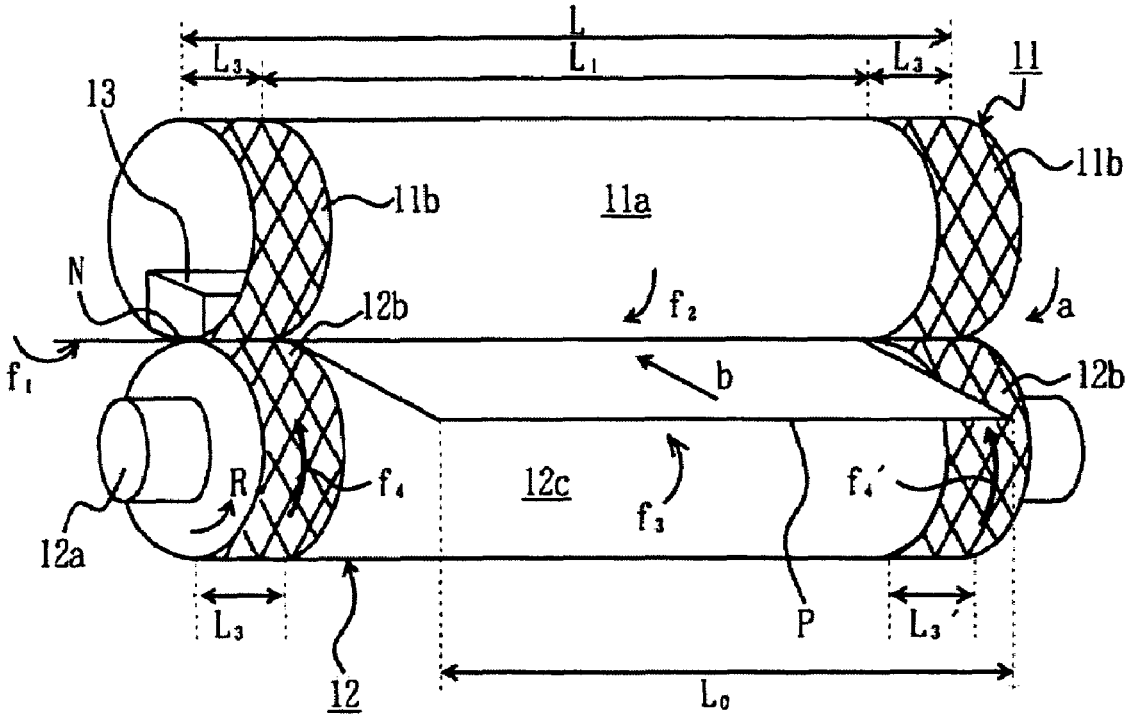
FIG. 17 is a view showing frictional force occurring during paper transmit according to the ninth embodiment of this invention.

FIG. 17 is a view showing frictional force occurring during paper transmit according to the ninth embodiment of this invention.

In this case, where the fusing belt 11 is rotated in the direction of the arrow a, and the pressure roller 12 serving as the pressure member is rotated in direction R. When the paper P serving as the recording medium transits through the nipping portion N in the direction of the arrow b, the frictional force $f_1$ exerts between the inner circumferential surface of the fusing belt 11 and the contact surface of the pushing member 13, in a direction of preventing the fusing belt from moving, the frictional force $f_2$ exerts in a direction of moving through the paper P the fusing belt 11, inside the transit area for the paper P in the nipping portion N, the frictional force $f_3$ exerts between the outer circumferential surface of the pressure roller 12 and the back surface of the paper P, in a direction of conveying the paper P, and the frictional force $f_4$, $f_4'$ exert in a direction of moving directly the fusing belt 11, between the outer circumferential surface of the fusing belt 11 and the outer circumferential surface of the pressure roller 12 at the non-transit area for the paper P.

In this embodiment, on the pressure roller 12, the friction coefficient of the non-transit area for the paper P is rendered larger than that of the transit area.

In this case, the pressure roller 12 has the core metal shaft 12*a*, the elastic layer 12*b* formed in a roller shape concentrically with respect to the core metal shaft 12*a*, made of the sponge material having high thermal resistance and thermal insulation property, and the mold-releasing layer 12*c* covered on the elastic layer 12*b*, having high mold releasing property and durability. A silicone sponge having a specific gravity of 0.9 is used as the elastic layer 12*b*, and the tube made of PFA having layer thickness of 30 [μm] is used as the mold-releasing layer 12*c* so that the total outer diameter of the pressure roller 12 is rendered of 35 [mm] while the total length thereof is rendered of 450 [mm].

On the pressure roller 12, the mold-releasing layer 12*c* is formed inside the mold-releasing layer width $L_1$ while not formed outside the mold-releasing layer width $L_1$, and the elastic layer 12*b* is exposed in the elastic layer exposed widths $L_3$, $L_3'$.

That is, with respect to the maximum paper transit width $L_0$ of 330 [mm], the mold-releasing layer width $L_1$ of 336 [mm] is formed, in which a margin composed of a distance of 3 [mm] is placed on each of the left and right sides, while elastic layer exposed widths $L_3$, $L_3'$ of 57 [mm] are respectively formed next to the left and right sides.

In this embodiment, the elastic layer 12*b* is exposed in forming the mold-releasing layer 12*c*, however, the friction coefficient can be increased upon rendering, after the mold-releasing layer 12*c* is covered on the total length of the pressure roller 12, the outer circumferential surface of the non-transit area for the paper P have a prescribed surface roughness by mean of a sandblasting process, a sandpaper process, a process using grindstone.

Furthermore, on the pressure roller 12, the coating layer made of a material having a large friction coefficient can be formed on the outer circumferential surface of the non-transit area for the paper P. Portions in a roller shape of the material having a large friction coefficient can be separately disposed on each of ends.

As described above, on the pressure roller 12, the friction coefficient can be increased only at the elastic layer exposed widths $L_3$, $L_3'$, so that the conveyance force of the pressure roller 12 for the medium P can be increased.

It is to be noted that the printer for forming multicolored images is described in this embodiment, but this invention is applicable to the printer for forming monochromatic images.

Furthermore, in each of the above described embodiments, the heating source is to be disposed inside the fusing belt 11, but can be disposed outside the fusing belt 11.

It is to be noted that this invention is not limited to these above described embodiments but can be variously modified based on the purpose of this invention, and these modifications are not excluded from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A fusing device comprising:

a belt having an inner circumferential surface and an outer circumferential surface, said belt has a base material, an elastic layer formed on said base material, and a mold-releasing layer formed on said elastic layer;

a pressure member disposed in contact with said belt for fusing a developer image on a recording medium at a contact area between said belt and said pressure member, the pressure member, the belt and the contact area extending continuously from a transit area for said recording medium to a non-transit area for said recording medium, the transit area for said recording medium located proximate to an axial center of said pressure member, the non-transit area for said recording medium located at an edge of said pressure member beyond the transit area; and a pushing member in contact with the inner circumferential surface of said belt and pushing said belt toward the pressure member, the pushing member extending from the transit area to the non-transit area for said recording medium, wherein said elastic layer is exposed in said non-transit area, wherein said belt has an escaping portion formed between a maximum recording medium transit width and an elastic layer exposed width, and wherein said mold-releasing layer has an end portion thereof placed inside said escaping portion;

wherein where a friction coefficient of an inner circumferential surface of said belt is set to $\mu_i$, a friction coefficient of the transit area for the recording medium on the outer circumferential surface of said belt is set to $\mu_{01}$, and a friction coefficient of the non-transit area for said recording medium on said outer circumferential surface of said belt, is set to $\mu_{02}$, so that a relationship of $\mu_{01}<\mu_i<\mu_{02}$ is satisfied.

2. The fusing device according to claim 1, wherein said escaping portion is defined as a groove formed to said elastic layer.

3. The fusing device according to claim 1, wherein said escaping portion is formed upon exposing said base material, and wherein said elastic layer placed outside said escaping portion has a friction coefficient rendered larger than that of said elastic layer placed inside said escaping portion.

4. A fusing device comprising:

a belt having an inner circumferential surface and an outer circumferential surface, said belt has a base material, an elastic layer formed on said base material, and a mold-releasing layer formed on said elastic layer;

a pressure member disposed in contact with said belt for fusing a developer image on a recording medium at a contact area between said belt and said pressure member, the pressure member, the belt and the contact area extending continuously from a transit area for said recording medium to a non-transit area for said recording medium, the transit area for said recording medium located proximate to an axial center of said pressure member, the non-transit area for said recording medium located at an edge of said pressure member beyond the transit area; and a pushing member in contact with the inner circumferential surface of said belt and pushing said belt toward the pressure member, the pushing member extending from the transit area to the non-transit area for said recording medium, wherein said elastic layer is exposed in said non-transit area, wherein said belt has an escaping portion formed between a maximum recording medium transit width and an elastic layer exposed width, and wherein said mold-releasing layer has an end portion thereof placed inside said escaping portion;

wherein where a friction coefficient of an inner circumferential surface of said belt is set to $\mu_i$, a friction coefficient of the transit area for the recording medium on the outer circumferential surface of said belt is set to $\mu_{01}$, and a friction coefficient of the non-transit area for said recording medium on said outer circumferential surface of said belt, is set to $\mu_{02}$, so that a relationship of $\mu_{01}<\mu_i<\mu_{02}$ is satisfied, wherein when said recording medium transits between said belt and said pressure member, where a frictional force exerting between said contact surface of said pushing member and said inner surface of said belt is set to $f_1$, where said frictional force exerting between said outer circumferential surface of said belt and said surface of said recording medium on said transit area is set to $f_2$, and where said frictional force exerting between said outer circumferential surface of said belt and said outer circumferential surface of said pressure member on said non-transit area is set to $f_4$, $f_4'$, a relation of $f_1<f_2<f_4+f_4'$ is satisfied.

5. The fusing device according to claim 4, wherein said escaping portion is defined as a groove formed to said elastic layer.

6. The fusing device according to claim 4, wherein said escaping portion is formed upon exposing said base material, and wherein said elastic layer placed outside said escaping portion has a friction coefficient rendered larger than that of said elastic layer placed inside said escaping portion.

* * * * *